US007846516B2

(12) United States Patent
Kamo et al.

(10) Patent No.: US 7,846,516 B2
(45) Date of Patent: Dec. 7, 2010

(54) INK JET RECORDING MEDIUM AND METHOD OF PRODUCING THE SAME

(75) Inventors: Hisao Kamo, Ushiku (JP); Hiroshi Asakawa, Ebina (JP); Hiroshi Kakihira, Kawasaki (JP); Hirokazu Hyakuda, Kawasaki (JP); Tetsuro Noguchi, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 12/206,976

(22) Filed: Sep. 9, 2008

(65) Prior Publication Data

US 2009/0011155 A1 Jan. 8, 2009

Related U.S. Application Data

(63) Continuation of application No. PCT/JP2008/057786, filed on Apr. 16, 2008.

(30) Foreign Application Priority Data

Apr. 18, 2007 (JP) ..... 2007-109894

(51) Int. Cl.
*B41M 5/50* (2006.01)

(52) U.S. Cl. ..... 428/32.25; 427/152; 428/32.34

(58) Field of Classification Search ..... None
See application file for complete search history.

(56) References Cited

U.S. PATENT DOCUMENTS

| | | | | |
|---|---|---|---|---|
| 4,434,226 | A | 2/1984 | Wilgus et al. | 430/567 |
| 5,122,814 | A | 6/1992 | Endo et al. | 346/33 R |
| 5,635,291 | A | 6/1997 | Yoshino et al. | 428/304.4 |
| 5,800,916 | A | 9/1998 | Yoshino et al. | 428/328 |
| 5,846,647 | A | 12/1998 | Yoshino et al. | 428/328 |
| 5,851,654 | A | 12/1998 | Yoshino et al. | 428/328 |
| 5,869,177 | A | 2/1999 | Yoshino et al. | 428/328 |
| 5,955,185 | A | 9/1999 | Yoshino et al. | 428/304.4 |
| 5,962,124 | A | 10/1999 | Yoshino et al. | 428/328 |
| 5,965,252 | A | 10/1999 | Santo et al. | 428/329 |
| 6,342,289 | B1 | 1/2002 | Eguchi et al. | 428/195 |

(Continued)

FOREIGN PATENT DOCUMENTS

EP 0 701 904 A1 3/1996

(Continued)

OTHER PUBLICATIONS

May 27, 2008 International Search Report in PCT/JP2008/057786 (with translation).

(Continued)

*Primary Examiner*—Bruce H Hess
(74) *Attorney, Agent, or Firm*—Fitzpatrick, Cella, Harper & Scinto

(57) ABSTRACT

The invention provides an ink jet recording medium which attains the prevention of the bronzing of cyan ink and the prevention of the migration of magenta ink at the same time and is excellent in image characteristics. The ink jet recording medium comprises a substrate and an ink-receiving layer provided with at least an upper layer as the outermost layer and a lower layer as a layer lying just under the upper layer, both layers having a porous structure formed of an alumina hydrate and a binder, wherein both of the upper and lower layers contain an alkylsulfonic acid and only the lower layer contains a cationic polymer.

7 Claims, 1 Drawing Sheet

U.S. PATENT DOCUMENTS

| | | | | |
|---|---|---|---|---|
| 6,521,323 | B1 | 2/2003 | Sakaki et al. | 428/195 |
| 6,558,740 | B1 | 5/2003 | Santo et al. | 427/146 |
| 6,649,661 | B2 | 11/2003 | Yoshino et al. | 516/93 |
| 6,848,781 | B2 | 2/2005 | Ogino et al. | 347/105 |
| 6,936,315 | B2 | 8/2005 | Onishi et al. | 428/32.1 |
| 7,144,613 | B2 | 12/2006 | Eguchi et al. | 428/32.37 |
| 7,291,361 | B2 | 11/2007 | Ogino et al. | 427/258 |
| 7,416,639 | B2 | 8/2008 | Yoshino et al. | 162/181.4 |
| 2003/0059584 | A1 | 3/2003 | Onishi et al. | 428/195 |
| 2004/0209015 | A1 | 10/2004 | Wickramanayake et al. | 428/32.31 |
| 2004/0209017 | A1 | 10/2004 | Zahrobsky et al. | 428/32.34 |
| 2005/0058786 | A1 | 3/2005 | Nagashima et al. | 428/32.31 |
| 2006/0182906 | A1 | 8/2006 | Kamo et al. | 428/32.34 |
| 2006/0188671 | A1 | 8/2006 | Kamo et al. | 428/32.34 |
| 2006/0194943 | A1 | 8/2006 | Hyakuda et al. | 528/354 |

FOREIGN PATENT DOCUMENTS

| | | | |
|---|---|---|---|
| EP | 0 741 045 | A1 | 11/1996 |
| EP | 0 749 845 | A2 | 12/1996 |
| EP | 1 468 836 | A2 | 10/2004 |
| JP | 58-113927 | | 7/1983 |
| JP | 5-16015 | B2 | 3/1993 |
| JP | 7-232473 | | 9/1995 |
| JP | 7-266689 | | 10/1995 |
| JP | 8-132731 | | 5/1996 |
| JP | 9-66664 | | 3/1997 |
| JP | 9-76628 | | 3/1997 |
| JP | 9-241548 | | 9/1997 |
| JP | 2002-283708 | | 10/2002 |
| JP | 2003-72231 | | 3/2003 |
| JP | 2004-314635 | | 11/2004 |
| JP | 2005-154577 | | 6/2005 |
| JP | 3683974 | B2 | 8/2005 |
| JP | 2005-262716 | | 9/2005 |

OTHER PUBLICATIONS

Oct. 29, 2009 International Preliminary Report on Patentability and Written Opinion in International Application No. PCT/JP2008/057786 (with English Translation).

J. Roček, et al., "Porous Structure of Aluminum Hydroxide and its Content of Pseudoboehmite," Applied Catalysis, vol. 74, 1991, pp. 29-36.

International Search Report and Written Opinion in PCT/JP2008/057786.

Nov. 19, 2009 International Preliminary Report on Patentability and Written Opinion Translation in International Application No. PCT/JP2008/057786, with Oct. 29, 2009 International Preliminary Report on Patentability and Written Opinion.

INK JET RECORDING MEDIUM AND METHOD OF PRODUCING THE SAME

CROSS-REFERENCE TO RELATED APPLICATIONS

This application is a continuation of International Application No. PCT/JP2008/057786, filed Apr. 16, 2008, which claims the benefit of Japanese Patent Application No. 2007-109894, filed Apr. 18, 2007.

BACKGROUND OF THE INVENTION

1. Field of the Invention

The present invention relates to an ink jet recording medium provided with an ink receiving layer excellent in the ability of preventing the bronzing of ink containing a coloring material and in the ability of fixing the ink. Particularly, the present invention relates to general technologies applicable to an ink jet recording medium excellent in the ability of preventing the bronzing of cyan ink and in the ability for fixing magenta ink.

2. Description of the Related Art

It is currently desired to improve image qualities in an ink jet printer and therefore, studies are being made as to improvements in ink jet recording mediums and also in ink and coloring material themselves. In printers, particularly, developed after the autumn in 2004, a coloring material is used for which the light fastness is predominantly taken into account, a remarkable technological innovation has been observed. As a result, with regard to recent developments in coloring materials, their technical contents have been almost brought together.

For example, materials primarily using carbon black are useful as black ink and materials primarily using D.Y. 132, 92 or the like are useful as yellow ink. These materials are therefore usually used. Also, anthrapyridine type coloring materials obtained from quinacridone type coloring materials which have three or more sulfonic groups as solubilizing groups and are provided with an addition structure such as a triazine ring are used as magenta ink.

Particularly, as cyan ink of a phthalocyanine type coloring material, a phthalocyanine type dye provided with an addition structure such as a triazine ring, having improved light fastness is used. Also, the pigment ink has been centered on the over-placed type with respect to glossy media which leaves many coloring materials on the surface of the media. Therefore, a system is adopted in which a transparent liquid is further added to protect these surface coloring materials.

In the meantime, the ink jet recording medium is generally provided with an ink receiving layer containing an inorganic pigment such as silica particles and alumina hydrate particles held with a polymer binder such as a polyvinyl alcohol. Because usual coloring materials provided to this ink jet recording medium is anionic, a cationic additive is usually added in the ink receiving layer of the ink jet recording medium with the intention of improving the fixability of ink. In many ink receiving layers, a polyvinyl alcohol (hereinafter referred to as "PVA") having a binder function is used to form a porous structure.

However, there is the case where the cationic additive causes the generation of bronzing.

There is a proposal in Japanese Patent Application Laid-Open No. 2005-262716 for preventing the generation of bronzing in a recording medium provided with two ink receiving layers. In the publication of Japanese Patent Application Laid-Open No. 2005-262716, there is disclosed a recording medium in which the lower layer of the ink receiving layer contains silica, water-soluble zirconium and a cationic polymer and the upper layer of the ink receiving layer contains an alumina hydrate and no cationic compound except the alumina hydrate.

Also, in Japanese Patent Application Laid-Open No. 2002-283708, there is the disclosure that in a recording medium provided with two ink receiving layers, the degree of cationization of the upper ink receiving layer is controlled to be lower than that of the lower ink receiving layer in order to reduce the generation of bronzing.

Moreover, in Japanese Patent Application Laid-Open No. 2004-314635, it is disclosed that an ink jet recording medium is adjusted to pH 8.5 or more to prevent bronzing simply.

Also, a polyallylamine has been used as the cationic additive excellent in ink fixability. In Japanese Patent Application Laid-Open No. H07-266689, Japanese Patent Application Laid-Open No. 2005-154577 and Japanese Patent No. 3683974, there is disclosed an ink jet recording medium using this polyallylamine as the cationic additive.

Japanese Patent Application Laid-Open No. 2005-262716 discloses a structure in which an upper layer coating liquid contains no cationic compound and a lower layer coating liquid contains a cationic compound as the condition required for production. Japanese Patent Application Laid-Open No. 2005-262716 determines that no cationic compound is contained in the upper layer of the ink jet recording medium only from the condition for production. However, the inventors of the present invention have made studies concerning this and as a result, found that the cationic compound added to the lower layer coating liquid (silica dispersion solution) is diffused in the upper-layer-forming coating liquid. This can be proven from the description "bronzing was slightly observed in a part of the colors" in the result of Example 1 of Japanese Patent Application Laid-Open No. 2005-262716. Particularly, 2% by mass of a cationic compound is added in the lower layer coating liquid (silica dispersion solution) in each example, showing that a cationic compound is diffused in the upper layer in all the examples.

In Japanese Patent Application Laid-Open No. 2005-262716, the cyan coloring material used in printers developed before the autumn in 2004 is a usual phthalocyanine dye which is a dye relatively resistant to the bronzing. However, if phthalocyanine dye with improved light fastness is used, the occurrence of a bronzing phenomenon has come to be observed not only, of course, in the ink jet recording medium described in Japanese Patent Application Laid-Open No. 2005-262716 but also in any of the conventional ink jet recording mediums.

In the meantime, a problem has arisen concerning migration in magenta ink. Here, the term "migration" represents a phenomenon that when an ink jet recording medium is allowed to stand in a high-temperature and high-humidity circumstance after ink is used to record, a water-soluble dye migrates in the ink jet recording medium.

In the recording medium using an alumina hydrate in both the upper layer and the lower layer as disclosed in Japanese Patent Application Laid-Open No. 2002-283708, a cationic polymer is contained only in the lower layer. However, the migration of magenta is insufficient.

Particularly, in printers developed after the autumn in 2004, the use of a coloring material is started for which the light fastness is given priority, and therefore, the migration of magenta ink became conspicuous.

As mentioned above, no specific development in the technologies of recording mediums has been made to solve both of the problems concerning (a) the occurrence of bronzing of cyan ink and (b) the generation of migration in magenta ink. This is because if a cationic polymer is added in the ink receiving layer to solve the above problem (b) concerning magenta ink, the cationic polymer exists extending throughout in the direction of the thickness of the ink receiving layer. There is the case where this causes cyan ink to flocculate, which promotes the problem (a) concerning bronzing, bringing about a more serious situation.

Also, in the case of ink using a cyan coloring material with improved flocculation characteristics resulting from the condition that the problem as to an improvement in fastness takes precedence over other problems in current improvements in coloring materials, a bronzing phenomenon tends to occur more conspicuously.

In view of this situation, the inventors of the present invention have made studies concerning the fixing state of each ink in an ink jet recording medium. The inventors have also made studies concerning the fixing state of ink containing an anthrapyridone type coloring material having three or more sulfonic groups or ink containing a phthalocyanine type dye to which a triazine ring is added to improve light fastness. As a result, the following findings have been obtained.

1) It has been clarified that the fixing region in the direction of the depth from the surface of an ink jet recording medium having, as the ink receiving layer, a porous layer containing an alumina hydrate and a binder differs depending on the type of coloring material in the ink. In specific examples, yellow ink, cyan ink and magenta ink were put to the ink receiving layer. As a result, the major fixing region of the yellow ink was present in a range from the surface to a depth of 5 μm or less and the major fixing region of the cyan ink was present in a range of the upper surface part and the vicinity of the surface. Also, the major fixing region of the magenta ink existed in a region relatively deep in the layer and specifically, in a region beyond 15 μm deep from the surface of the ink jet recording medium. In short, it has been found that the fixing region in the direction of the depth in the ink jet recording medium varies depending on the type of coloring material.

2) Such a tendency that the fixing region varies depending on the type of ink is significant with the difference being increased when the ink formed liquid droplets are 5.5 pico liters (preferably 1 pico liter or more) or less in size and particularly small liquid droplets about 2 pico liters. At the same time, a difference in the size of dots formed corresponding to these liquid droplets was observed.

3) Studies made as to the diffusion condition of additives makes it possible to attain the functional separation of the ink receiving layer by localizing the ink fixing region depending on the type of ink in the ink receiving layer. As a result, the above problem has been solved and a novel ink jet recording medium has been provided that can cope to the future trend of the development of coloring materials and is beyond the current technological level.

Specifically, it is a first object to provide a recording medium that can correspond to fixing regions differing in inks or coloring materials in an ink receiving layer and can cope to each characteristic of the coloring materials.

Also, it is a second object to provide an ink jet recording medium that limits the migration of magenta ink preferentially, can preferably attain the prevention of the bronzing of cyan ink at the same time and is excellent in image characteristics.

SUMMARY OF THE INVENTION

A first invention relates to an ink jet recording medium comprising a substrate and an ink receiving layer provided with at least an upper layer and a lower layer formed on the above substrate, wherein the above upper layer: (A) constitutes the outermost layer of the above ink receiving layer; (B) contains none of a polyallylamine hydrochloride, a methyldiallylamine hydrochloride polymer and a diallylamine hydrochloride-sulfur dioxide copolymer; and (C) contains inorganic pigment particles, a binder and an alkylsulfonic acid of which the alkyl group is a straight or branched unsubstituted alkyl group having 1 to 4 carbon atoms; and the above lower layer: (D) is a layer lying just under the upper layer; and (E) contains at least one cationic polymer selected from the group consisting of a polyallylamine hydrochloride, a methyldiallylamine hydrochloride polymer and a diallylamine hydrochloride-sulfur dioxide copolymer, inorganic pigment particles, a binder and an alkylsulfonic acid of which the alkyl group is a straight or branched unsubstituted alkyl group having 1 to 4 carbon atoms; wherein the ratio by mass of the cationic polymer contained in the lower layer to the inorganic pigment particles contained in the above upper layer and lower layer, {(Cationic polymer)/(Inorganic pigment particles)×100}, is 0.1% or more and 1% or less; and the ratio by mass of the alkylsulfonic acid to the inorganic pigment particles contained in the above upper layer and lower layer, {(Alkylsulfonic acid)/(Inorganic pigment particles)×100}, is 1.4% or more and 2.1% or less.

All the inorganic pigment particles in the upper layer and lower layer are preferably alumina hydrates, and the upper and lower layers both preferably have porous structures formed of the alumina hydrate and the binder.

The total thickness of the upper and lower layers is preferably 30 μm or more. The thickness of the upper layer is preferably 2 μm or more and 10 μm or less.

A second invention relates to a method of producing an ink jet recording medium, the method comprising applying an upper layer coating liquid and a lower layer coating liquid to the surface of a substrate to form an ink receiving layer provided with an upper layer and a lower layer on the substrate, wherein the above upper layer coating liquid: contains inorganic pigment particles, a binder and an alkylsulfonic acid of which the alkyl group is a straight or branched unsubstituted alkyl group having 1 to 4 carbon atoms; and contains none of a polyallylamine hydrochloride, a methyldiallylamine hydrochloride polymer and a diallylamine hydrochloride-sulfur dioxide copolymer; the above lower layer coating liquid: contains at least one cationic polymer selected from the group consisting of a polyallylamine hydrochloride, a methyldiallylamine hydrochloride polymer and a diallylamine hydrochloride-sulfur dioxide copolymer, inorganic pigment particles, a binder and an alkylsulfonic acid of which the alkyl group is a straight or branched unsubstituted alkyl group having 1 to 4 carbon atoms; the ratio by mass of the cationic polymer contained in the lower layer coating liquid to the inorganic pigment particles contained in the above upper layer coating liquid and lower layer coating liquid, {(Cationic polymer)/(Inorganic pigment particles)×100}, is 0.1% or more and 1% or less; and the ratio by mass of the alkylsulfonic acid to the inorganic pigment particles contained in the above upper layer coating liquid and lower layer coating liquid, {(Alkylsulfonic acid)/(Inorganic pigment particles)×100}, is 1.4% or more and 2.1% or less.

The lower layer coating liquid and the upper layer coating liquid are preferably applied simultaneously to the substrate.

The inorganic pigment particles are preferably alumina hydrates.

In this specification, a polyallylamine hydrochloride, a methyldiallylamine hydrochloride polymer and a diallylamine hydrochloride-sulfur dioxide copolymer are generically called "cationic polymer". Among these compounds, a diallylamine hydrochloride-sulfur dioxide copolymer is preferable because it can more improve the effect of preventing yellowing and can more improve the effect of the present invention.

Also, the description "contains no cationic polymer" means that none of a polyallylamine hydrochloride, a methyldiallylamine hydrochloride polymer and a diallylamine hydrochloride-sulfur dioxide copolymer is intentionally added.

In the first invention, the recording medium is provided with the upper layer containing no cationic polymer. For this, cyan ink to be fixed in a shallow region of the surface of the ink receiving layer is fixed in the upper layer to prevent the occurrence of bronzing efficiently.

Also, in the lower layer, the cationic polymer is contained such that the ratio by mass of the cationic polymer contained in the lower layer, {(Cationic polymer)/(Inorganic pigment particles) 100}, is 0.1% or more and 1% or less.

When the ratio of the cationic polymer is in the above range, magenta ink to be fixed in a region relatively deep in the ink receiving layer can be efficiently fixed in the lower layer by the interaction with this cationic polymer without diffusing this cationic polymer into the upper layer.

Moreover, alkylsulfonic acid is contained in both layers. As to the content of the alkylsulfonic acid, the ratio by mass of the alkylsulfonic acid to the inorganic pigment particles contained in the above upper layer and lower layer, {(Alkylsulfonic acid)/(Inorganic pigment particles)×100}, is 1.4% or more and 2.1% or less.

Therefore, a magenta coloring material did not penetrate deep into the ink absorbent recording medium and its fixing region could be secured in the top side of the lower layer (desired region inside of the ink absorbent recording medium). Therefore, with regard to the magenta ink, a desired image density (OD) could be obtained.

Also, the occurrence of the migration of the magenta ink could be effectively prevented over time.

In other words, (a) the occurrence of the migration of cyan ink and the occurrence of the migration of magenta ink could be both solved. Also, other inks were evaluated and as a result, more excellent image density than those of current inks could be obtained. Also, from the point of view of an image, bleeding between different colors was significantly improved by the upper layer with improved ink absorbency.

In the second invention, a recording medium having the above structure can be obtained efficiently.

DESCRIPTION OF THE EMBODIMENTS

A recording medium according to the present invention will be explained based on its preferred embodiments.

Figure 1:
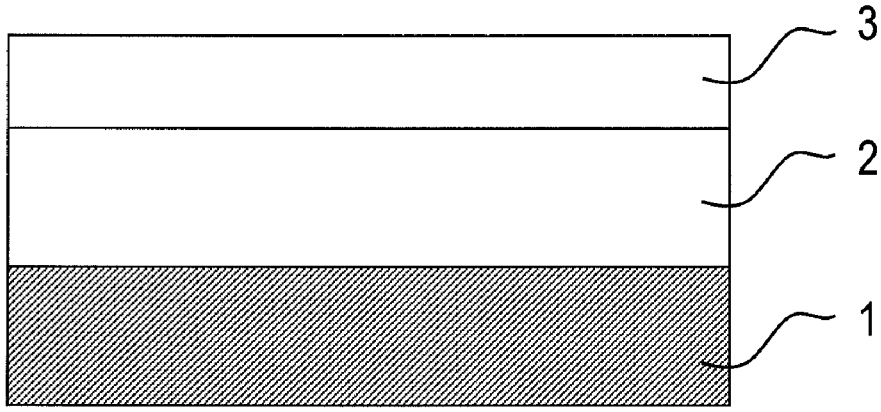
FIG. 1 is a sectional view of an ink jet recording medium in an aspect of the present invention.

The ink jet recording medium of the present invention is provided with a substrate 1 and an ink receiving layer including an upper layer 3 and a lower layer 2 formed on the substrate as shown in FIG. 1. The substrate may be provided with a surface treated layer. Also, a backface may be formed thereto according to the need.

The ink jet recording medium of the present invention is obtained by applying an upper layer coating liquid and a lower layer coating liquid to the substrate.

(Ink Receiving Layer)

The upper layer of the ink receiving layer in the present invention: (A) is the outermost layer of the ink receiving layer; (B) contains none of a polyallylamine hydrochloride, a methyldiallylamine hydrochloride polymer and a diallylamine hydrochloride-sulfur dioxide copolymer; and (C) contains inorganic pigment particles, a binder and an alkylsulfonic acid of which the alkyl group is a straight or branched unsubstituted alkyl group having 1 to 4 carbon atoms.

Also, the above lower layer of the ink receiving layer: (D) is a layer lying just under the upper layer; and (E) contains at least one cationic polymer selected from the group consisting of a polyallylamine hydrochloride, a methyldiallylamine hydrochloride polymer and a diallylamine hydrochloride-sulfur dioxide copolymer, inorganic pigment particles, a binder and an alkylsulfonic acid of which the alkyl group is a straight or branched unsubstituted alkyl group having 1 to 4 carbon atoms; wherein the ratio by mass of the cationic polymer contained in the lower layer to the inorganic pigment particles contained in the above upper layer and lower layer, {(Cationic polymer)/(Inorganic pigment particles)×100}, is 0.1% or more and 1% or less; and the ratio by mass of the alkylsulfonic acid to the inorganic pigment particles contained in the above upper layer and lower layer, {(Alkylsulfonic acid)/(Inorganic pigment particles)×100}, is 1.4% or more and 2.1% or less.

Generally, in an embodiment more suitable for magenta ink, the cationic polymer is preferably provided on the recording medium side. On the other hand, this brings about the worst bronzing effects of cyan ink due to the cationic polymer. Since the ink absorbent recording medium of the present invention has the structure in which the existence region of the cationic polymer is defined in a specified region of the ink receiving layer as mentioned above, it can bring about such an excellent action effect as mentioned above.

Also, as the ink receiving layer is made to contain an alkylsulfonic acid, magenta ink can be prevented from penetrating deep into the ink receiving layer.

When ink absorbency of the upper layer of the ink receiving layer is improved, the magenta ink penetrates deep into the inside more easily. However, in the present invention, a stable image formation region is present in a specific fixing region in the above upper layer. At the same time, this upper layer prevents the occurrence of bleeding by the effect of improving the ink absorbency and reduces the residence of cyan ink on the surface due to the absorption toward the inside. As a result, the occurrence of bronzing can be prevented.

Because the image density of the fixed ink significantly depends on the thickness of the upper layer, the thickness of the upper layer is 2 μm or more and 15 μm or less and more preferably 10 μm or less.

Also, the thickness of the upper layer is more preferably 3 μm or more from the viewpoint of the stability of the formation of the upper layer. Moreover, the thickness of the upper layer is more preferably 10 μm. As the above cationic polymer, a diallylamine hydrochloride-sulfur dioxide copolymer producing the effect of preventing yellowing together is preferable.

The total thickness of the upper and lower layers is preferably 30 μm or more in consideration of full solid printing. This is because when the substrate is made of the so-called resin coated paper, there is the case where the series of water and a solvent and the like in the ink are insufficient. The thickness is more preferably 35 μm or more and 40 μm or less.

The ink receiving layer of the present invention preferably forms a porous structure made of inorganic pigment particles and a binder. As the inorganic pigment particles, alumina hydrates are preferably used. With regard to the ratio, (Binder)/(Pigment particles)×100, for the above upper layer, the alumina hydrate and the binder are preferably contained in a specific ratio in the upper layer such that the ratio, (Binder)/(Pigment particles)×100, is 4.0% by mass or more and 6.0% by mass or less. This ensures that the part occupied by the binder is decreased as much as possible in the porous structure in the upper layer to increase the pore volume of the porous structure while maintaining the mechanical strength required for the ink receiving layer and the ability to retain the layer. As a result, the recording medium can have high ink penetrability (ink absorbency), making it possible to prevent the bleeding of the ink on the surface of the upper layer efficiently.

Here, when the ratio, (Binder)/(Pigment particles)×100, is less than 4.0% by mass, there is such a tendency that it is difficult to bind the alumina hydrate with the binder in an amount necessary to form the layer. As a result, cracks easily occur in the ink receiving layer so that the mechanical strength of the ink receiving layer becomes insufficient, and there is such a tendency that a powder falling easily occurs. When the ratio (Binder)/(Pigment particles)×100 exceeds 6.0% by mass, on the other hand, this brings about the situation where many pores of the porous structure in the ink receiving layer are occupied by the binder. As a result, the pore volume of the porous structure in the ink receiving layer is reduced, which hinders the penetration of ink droplets into the upper layer. Then, when, for example, neighboring solid prints differing in color are printed, there is the case where each ink bleeds in other region at the boundary of both layers. The ratio (Binder)/(Pigment particles)×100 in the upper layer is preferably 4.5% by mass or more and 5.5% by mass or less.

The alumina hydrate and the binder are preferably contained in a specific ratio in the lower layer such that the ratio (Binder)/(Pigment particles)×100 is 7.0% by mass or more and 12% by mass or less. In this case, the lower layer can be bound with the upper layer with high adhesive strength while maintaining the mechanical strength required for the ink receiving layer and the characteristics required for the support layer for the upper layer. Also, if the amount of the binder with respect to the alumina hydrate is made larger in the lower layer than in the upper layer, the ink penetrability into the lower layer can be decreased.

In short, the ratio by mass of the binder can be made to be appropriate to occupy the inside of the porous structure of the lower layer with the binder, thereby decreasing the volume of the porous structure to a level proper to retard ink penetrability. Moreover, because ink droplets that have penetrated the upper layer reach this lower layer, the penetration speed of the ink relatively drops due to penetration resistance in the upper layer when the ink reaches the lower layer. For this, the ink penetrability can be made to be lower in the lower layer than in the upper layer. When the ink penetrability is made to be lower in the lower layer than in the upper layer as mentioned above, the penetration speed of the ink can be changed sharply in the vicinity of the boundary between the upper layer and the lower layer.

(Substrate)

As the substrate to be used in the present invention, those made of papers or films such as cast coated paper, baryta paper and resin coated paper (resin coated paper of which both surfaces are coated with a resin such as a polyolefin or the like) are preferably used. As this film, the following transparent thermoplastic resin films may be used: polyethylene, polypropylene, polyester, polylactic acid, polystyrene, polyacetate, polyvinyl chloride, cellulose acetate, polyethylene terephthalate, polymethylmethacrylate and polycarbonate.

Besides the above materials, non-sized paper, coated paper which are papers processed by moderate sizing or a sheet-like material (synthetic paper) made of a film made to be opaque by filling inorganic materials or by fine foaming may be used. Also, a sheet made of glass, a metal or the like may be used. The surface of the substrate may be processed by corona discharge treatment or various undercoating treatments to improve the adhesive strength of the ink receiving layer to each of these substrates.

Among the aforementioned substrates, resin coated paper is preferably used from the point of, for example, the gloss feeling of the recording medium after the ink receiving layer is formed.

(Cationic Polymer)

In this specification, the term "cationic polymer" expresses a general term of a polyallylamine hydrochloride, a methyldiallylamine hydrochloride polymer and a diallylamine hydrochloride-sulfur dioxide copolymer. Namely, the cationic polymer indicates at least one type selected from the group consisting of a polyallylamine hydrochloride, a methyldiallylamine hydrochloride polymer and a diallylamine hydrochloride-sulfur dioxide copolymer.

A magenta dye which is a coloring material of magenta ink has such a characteristic that it is resistant to insolubilization and flocculation caused by acid precipitation in an acidic range unlike azo type dyes and phthalocyanine dyes. Therefore, only decreasing the pH of the paper surface is insufficient to obtain a satisfactory migration preventive effect. For this, a cationic polymer is made to be added in the lower layer to thereby flocculate and fix the magenta dye which is a coloring material of magenta ink efficiently, whereby migration can be suppressed. This cationic polymer produces an excellent effect on the fixability of a quinacridone type dye and a most excellent effect on fixing of an anthrapyridone type dye.

In a typical example, a magenta dye penetrates to a depth of 20 μm from the surface of the ink receiving layer when magenta ink is applied to the surface of the ink receiving layer. For this, even if a cationic polymer is present at a part deeper than the position where the magenta dye is fixed, a sufficient effect of suppressing the migration of the magenta ink cannot be obtained. It is therefore preferable that the cationic polymer is not present in the surface of the upper layer of the ink receiving layer but is present within a region to a depth of 20 μm from the surface of the upper layer.

When the mass average molecular mass of the cationic polymer to be added in the coating liquid is small, the cationic polymer diffuses into the upper layer when the upper layer and lower layer are applied, causing a deterioration in bronzing resistance. Also, in the case where the ink receiving layer contains water in a high content when it is stored under a highly humid condition, the cationic polymer also diffuses on the surface of the upper layer of the ink receiving layer to cause migration. Therefore, the mass average molecular mass of the cationic polymer is preferably 3000 or more from the viewpoint of preventing the cationic polymer from diffusing to the surface side of the upper layer. On the other hand, when the mass average molecular mass of the cationic polymer is too large, there is the case where the cationic polymer undergoes an flocculation reaction with the alumina hydrate when the alumina hydrate such as an alumina hydrate is dispersed, so that the transparency of the ink receiving layer is deteriorated, causing a deterioration in qualities such as a decrease in image density. For this, the mass average molecular mass of the cationic polymer is preferably 15000 or less. The mass average molecular mass of the cationic polymer is more preferably 5000.

Also, when the amount of the cationic polymer to be added to the lower layer coating liquid is excessive, the haze of the receiving layer is high, causing OD reduction and bronzing. When the amount of the cationic polymer is reduced, the dyeing effect of the dye is reduced and there is the case where the effect of suppressing the migration of magenta and color stability are insufficiently obtained. For this, the ratio by mass of the cationic polymer contained to the inorganic pigment particles contained in the lower layer coating liquid, {(Cationic polymer)/(Inorganic pigment particles)×100}, is preferably 0.5% or more and 1.0% or less and more preferably 0.5% or more and 0.75% or less from the viewpoint of suppressing a reduction in OD and bronzing and improving the effect of limiting migration and color stability at the same time.

Also, because the diffusion of the cationic polymer to the surface of the upper layer of the ink receiving layer occurs by the aid of water, it is preferable to use a cationic polymer having not many solubilizing groups or a cationic polymer having a bulky part. It is therefore preferable to use a bulky diallylamine hydrochloride-sulfur dioxide copolymer as a primary chain.

Examples of the cationic polymer which may be used in the present invention will be explained.

The polyallylamine hydrochloride is a compound represented by the following formula (1):

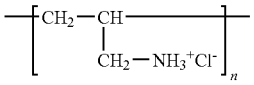

(1)

In the formula, n is preferably 30 or more and 160 or less.

The methyldiallylamine hydrochloride polymer is a compound represented by the following formula (2):

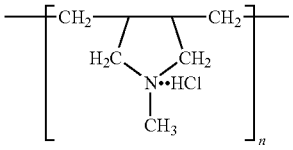

(2)

In the formula, n is preferably 27 or more and or less.

The diallylamine hydrochloride-sulfur dioxide copolymer is a compound represented by the following formula (3):

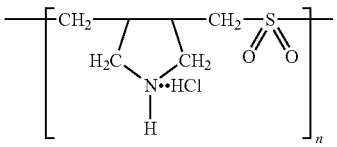

(3)

In the formula, n is preferably 15 or more and 77 or less.

When an alumina hydrate is used as the inorganic pigment particles, the dispersion properties of alumina can be favorable by the interaction with the cationic polymer. Among these cationic polymers, a diallylamine hydrochloride-sulfur dioxide copolymer is preferably used from the viewpoint of suppressing yellowing with time and OD. Because the diallylamine hydrochloride-sulfur dioxide copolymer has a bulky part, the diffusion of this copolymer to the surface of the ink receiving layer can be prevented when the lower layer coating liquid is applied.

Moreover, the ratio by mass of (Total amount of the cationic polymer and the methane sulfonic acid)/(Inorganic pigment particles) in the upper and lower layers is preferably 1.5% or more and 2.7% or less.

(Alkyl Sulfonic Acid)

In the present invention, the upper layer and the lower layer respectively contain an alkylsulfonic acid with a straight or branched alkyl group having 1 to 4 carbon atoms and the ratio by mass of the alkylsulfonic acid to the alumina hydrate contained in the above upper layer and lower layer, {(Alkylsulfonic acid)/(Inorganic pigment particles)×100}, is 1.4% or more and 2.1% or less.

It is known that there is the case where if the pH of the ink receiving layer is too low, this promotes the flocculation of a dye of a cyan ink and so on to cause bronzing. For this, the whole ink receiving layer is adjusted preferably to the pH range of from 4.5 to 5.5, more preferably from 4.8 to 5.3 and even more preferably to pH 5.1.

When an alumina hydrate is used in the receiving layer, on the other hand, the pH buffering ability of the pigment itself is stronger than that of silica and it is therefore difficult to control the pH of the layer. For this, in a recording medium using an alumina hydrate as the receiving layer material, a monovalent acid having a low acid dissociation constant is effective as the acid for controlling the paper surface pH. Specifically, an alkylsulfonic acid, nitric acid and hydrochloric acid are considered. However, nitrates pose a chemical safety problem and hydrochloric acid poses the problem that it corrodes the metal parts such as SUS of the production line. Therefore, it is preferable to use an alkylsulfonic acid as the acid for controlling the paper surface pH. Accordingly, in the present invention, the ratio by mass of the alkylsulfonic acid to the alumina hydrate contained in the above upper layer and lower layer, {(Alkylsulfonic acid)/(Inorganic pigment particles)×100}, is designed to be 1.4% or more and 2.1% or less. This ensures that the whole ink receiving layer can be controlled in the above pH range.

This alkylsulfonic acid is superior to weak acids, such as formic acid, acetic acid or glycolic acid, having a buffer function, in controlling the pH of the ink receiving layer with ease.

Also, when the ratio by mass of the alkylsulfonic acid is in the above range, the magenta dye is prevented from penetrating excessively deep into the layer, making possible to improve image density. At the same time, the migration resistance of a magenta dye can be improved.

The ratio by mass of the alkylsulfonic acid, {(Alkylsulfonic acid)/(Inorganic pigment particles)×100}, is designed to be preferably 1.4% or more and 1.9% or less and more preferably 1.4% or more and 1.7% or less. This can more improve the migration resistance of a magenta dye and can also improve the color stability and image density when printing using black ink.

The alkylsulfonic acid is preferably a monobasic acid having only a sulfonic acid group as the solubilizing group and the alkyl group is preferably a straight or branched unsubstituted alkyl group having no solubilizing group typified by a hydroxyl group or a carboxylic acid group in terms of the improvement of migration.

On the other hand, an alkylsulfonic acid having a solubilizing group tends to retain water in the porous layer due to the solubilizing group which does not participate in the peptization of alumina, bringing about a significant deterioration in migration characteristics, showing that this acid is not practical.

In ink jet system printing, it is desired that original high image density be obtained immediately after printing and thus a print image be obtained simply. The alkylsulfonic acid having 4 or less carbon atoms can improve color stability and image density when printing using black ink. However, in the case where the alkyl chain has 5 or more carbon atoms or benzenesulfonic acid or p-toluenesulfonic acid is used, color stability is impaired and image density is reduced. This reason is considered to be that when the alkyl chain has 5 or more carbon atoms, the hydrophobic properties of the alkyl group are increased, so that the hydrophobic properties of the surface of alumina are increased, the dye fixing speed on the surface of alumina is low, resulting in deteriorated color stability and low image density.

In the present invention, the alkylsulfonic acid is a monobasic acid and the alkyl group is a straight or branched alkyl group having 1 to 4 carbon atoms, and therefore, the migration and color stability can be improved at the same time.

Also, when alumina is peptized by an alkylsulfonic acid having 5 or more carbon atoms or a single sulfonic acid having a benzene ring, sufficient dispersibility is not obtained and the viscosity is easily increased. For this, the production suitability is low and therefore, not only insufficient productivity is obtained but also unsatisfactory dispersibility is obtained and there is therefore the case where alumina is flocculated, causing a reduction in image density.

For this, the alkyl group of the alkylsulfonic acid preferably has 1 to 4 carbon atoms in view of productive suitability. Examples of the alkylsulfonic acid to be used in the present invention include methanesulfonic acid, ethanesulfonic acid, isopropanesulfonic acid, n-propanesulfonic acid, n-butanesulfonic acid, I-butansulfonic acid and t-butansulfonic acid. More preferably, methanesulfonic acid, ethanesulfonic acid, isopropanesulfonic acid and n-propanesulfonic acid having 1 to 3 carbon atoms are used.

Of these, methanesulfonic acid is more preferably used in view of pH adjustable characteristics and dye fixability.

(Alumina Hydrate)

In the present invention, an alumina hydrate is preferably used in the upper and lower layers as one satisfying dye fixability, transparency, printing density, chromaticity and glossiness. As the alumina hydrate, for example, those represented by the following formula (X) may be suitably utilized.

$$Al_2O_{3-n}(OH)_{2n}\text{-}mH_2O \quad (X)$$

In the above formula, n denotes an integer of 1, 2 or 3 and m denotes a number from 0 to 10 and preferably 0 to 5, provided that m and n are not 0 at the same time. In many cases, $mH_2O$ represents a dissociable water phase which does not participate in the formation of a crystal lattice and therefore, m may take an integer or a value which is not an integer. Also, when this type of material is heated, there is the case where m reaches 0.

As the crystal structure of the alumina hydrate, an amorphous type, gibbsite type and boehmite type depending on treating temperature are known and an alumina hydrate having any of these crystal structures may be used.

Among these alumina hydrates, those having a boehmite structure or amorphous structure which are found by analysis using the X-ray diffraction method are suitable. Specific examples of these alumina hydrates may include alumina hydrates as described in Japanese Patent Application Laid-Open No. H07-232473, Japanese Patent Application Laid-Open No. H08-132731, Japanese Patent Application Laid-Open No. H09-066664 and Japanese Patent Application Laid-Open No. H09-076628.

As this alumina hydrate, it is preferable to use one having an average pore radius of 7.0 nm or more and 10 nm in the whole ink receiving layer when the ink receiving layer is formed. It is more preferable to use one having an average pore radius of 8.0 nm or more and 10 nm or less in the whole ink receiving layer when the ink receiving layer is formed. Here, the whole ink receiving layer indicates a layer including the upper and lower layers which are formed using the alumina hydrate and the binder. When the average pore radius of the whole ink receiving layer is in the above range, excellent ink absorbency and chromaticity can be exhibited. Also, when the average radius of the whole ink receiving layer is less than the above range, insufficient ink absorbency is obtained and there is therefore the case where satisfactory ink absorbency is not obtained even if the amount of the binder with respect to the alumina hydrate is regulated. Also, when the average pore radius of the whole ink receiving layer exceeds the above range, the haze of the whole ink receiving layer is increased and there is therefore the case where good chromaticity is not obtained.

The pore volume of the whole ink receiving layer is preferably 0.50 ml/g or more in terms of total pore volume. When the total pore volume is less than this value, the ink absorbency of the whole ink receiving layer is insufficient, and there is the case where satisfactory ink absorbency cannot be obtained even if the amount of the binder with respect to the alumina hydrate is regulated.

Moreover, as to the pore radius of the ink receiving layer, it is preferable that pores having a pore radius of 25 nm or more are not present. When pores having a pore radius of 25 nm or more exist, there is the case where the haze of the ink receiving layer is increased and good chromaticity is not obtained.

The above average pore diameter, total pore volume and pore radius are values obtained by using the BJH (Barrett-Joyner-Halenda) method from an adsorption-desorption isothermal line of nitrogen gas which is obtained by measuring a recording medium according to the nitrogen adsorption-desorption method. The average pore diameter, in particular, is a value found by calculation from the total volume and specific surface area measured when nitrogen gas is desorbed.

When the ink absorbent recording medium is measured by the nitrogen adsorption-desorption method, parts other than the ink receiving layer are also eventually measured. However, components other than the ink receiving layer (for example, a pulp layer of the substrate and resin coating layer) have no pore having a diameter range from 1 to 100 nm which is the range which can be measured by the nitrogen adsorption-desorption method. For this, when the ink absorbent recording medium is measured by the nitrogen adsorption-desorption method, it is considered that the average pore diameter is measured resultantly by the nitrogen adsorption-desorption method. This is inferred from the fact that when the pore distribution of resin coated paper is measured by nitrogen adsorption-desorption method, no pore having a pore diameter of 1 to 100 nm is present.

In order to obtain the average pore diameter obtained when the ink receiving layer is formed, it is preferable to use an alumina hydrate having a BET specific surface area of 100 $m^2/g$ or more and 200 $m^2/g$ or less. The average pore diameter in the ink receiving layer is more preferably 125 $m^2/g$ or more and 175 $m^2/g$ or less.

The above BET method is one of the methods for measuring the surface area of a powder by the vapor phase adsorption method and is a method used to find the total surface area of a 1 g of sample, that is, specific surface area, from the adsorption isothermal line. In this BET method, such a method is most chiefly used that nitrogen gas is used as the adsorption gas and the adsorption amount is measured from a variation in the pressure or volume of gas to be adsorbed. At this time, a most famous one expressing the isothermal line of multimolecular adsorption is the Brunauer, Emett, Teller equation, which is called the BET equation and used to determine specific surface area. In the above BET method, the adsorption amount is found based on the BET equation and is multiplied by the area occupied by one adsorbed molecule on the surface to thereby find the specific surface area. In the BET method, in measurement of the nitrogen adsorption-desorption method, several points of adsorption amount as a function of relative pressure are measured to calculate the slope and intercept of the plots by the method of least square, thereby finding the specific surface area. For this, preferably at least five points and more preferably 10 or more points showing adsorption amount-relative pressure characteristic are measured to raise the accuracy of the measurement.

As to the suitable shape of the alumina hydrate, an alumina hydrate is preferable which has a platelet shape, wherein the average aspect ratio is 3.0 or more and 10 or less and the length-breadth ratio of the surface of the platelet is 0.60 or more and 1.0 or less. In this case, the aspect ratio may be found by the method described in Japanese Patent Publication No. H05-016015. Specifically, the aspect ratio is shown by the ratio of the (diameter) to (thickness) of a particle. Here, the term "diameter" means the diameter (circle equivalent diameter) of a circle having an area equal to the projected area of the alumina hydrate when the alumina hydrate is observed by a microscope or an electron microscope. Also, the length-breadth ratio of the surface of the platelet means the ratio of the minimum diameter to maximum diameter of the surface of the platelets when a particle is observed by a microscope in the same manner as in the case of the aspect ratio.

When an alumina hydrate having an aspect ratio out of the above range is used, there is the case where the range of pore distribution of the formed ink receiving layer is narrowed. There is therefore the case where it is difficult to produce alumina hydrate particles having uniform particle diameters. Also, similarly, when an alumina hydrate having a length-breadth ratio out of the above range is used, the range of pore distribution of the ink receiving layer is narrowed.

It is known that there are alumina hydrates having a ciliary form and alumina hydrates having no ciliary form as described in Rocek J. et al., Applied Catalysis, Vol. 74, 1991, pp. 29-36. According to the findings of the inventors of the present invention, platelet alumina hydrates have higher dispersibility than ciliary alumina hydrates although they are the same alumina hydrates. Also, ciliary alumina hydrates are made to orient in parallel to the surface of the substrate when applied, so that the formed pores are decreased in size with the result that there is the case where the ink absorbency of the ink receiving layer is decreased. On the contrary, the platelet alumina hydrate has a less tendency to orient when applied and scarcely exerts an adverse influence on the size of pores of the ink receiving layer and ink absorbency of the ink receiving layer. It is therefore preferable to use a platelet alumina hydrate.

(Binder)

The ink receiving layer of the present invention contains a binder. As the binder, any materials may be utilized without any particular limitation insofar as it is a material having the ability to bind the alumina hydrate given above and it falls in the range where the effect of the present invention is not impaired. The following may be given as examples of the binder.

- Starch derivatives such as oxidized starch, etherified starch and phosphated starch
- Cellulose derivatives such as carboxymethyl cellulose and hydroxyethyl cellulose
- Casein, gelatin, soybean protein, polyvinyl alcohol or their derivatives
- Conjugate polymer latexes of a polyvinyl pyrrolidone, maleic acid anhydride resin, styrene-butadiene copolymer, methylmethacrylate-butadiene copolymer or the like
- Acryl type polymer latexes of, for example, polymers of acrylates or methacrylates
- Vinyl type polymer latexes of an ethylene-vinyl acetate copolymer or the like.
- Functional-group-modified polymer latexes obtained by polymerizing monomers containing a functional group such as a carboxyl group from the above various polymers
- Cationized polymers obtained by cationizing the above various polymers by using a cationic group and those obtained by cationizing the surface of the above various polymers with cationic surfactants.
- Polymers obtained by polymerizing the above various polymers in the presence of a cationic polyvinyl alcohol to distribute the polyvinyl alcohol on the surface of the polymer
- Polymers obtained by polymerizing the above various polymers in a suspension solution of cationic colloid particles to distribute the cationic colloid particles on the surface thereof
- Aqueous binders of, for example, heat curable synthetic resins such as a melamine resin and urea resin
- Polymer or copolymer resins of acrylates or methacrylates such as a polymethylmethacrylate; and
- Synthetic resin type binders such as a polyurethane resin, unsaturated polyester resin, vinyl chloride-vinyl acetate copolymer, polyvinylbutyral or alkyd resin The above binders may be used either singly or by mixing plural types. Among these materials, the binder which is most preferably used is a polyvinyl alcohol. Examples of the polyvinyl alcohol may include general polyvinyl alcohols obtained by hydrolyzing polyvinyl acetates. As this polyvinyl alcohol, those having an average degree of polymerization of 1500 or more are preferably used and those having an average degree of polymerization of 2000 or more and 5000 or less are more preferable. Also, those having a degree of saponification of 80 or more and 100 or less are preferable and those having a degree of saponification of 85 or more and 100 or less are more preferable.

In the present invention, the alumina hydrate and the cationic polymer can be flocculated mildly in the step of dispersing the lower layer coating liquid when the alumina hydrate and the cationic polymer are used for the lower layer. Also, in the course of drying when the coating liquid is applied, the cationic polymer is secured within the lower layer constituted of the alumina hydrate by rapid flocculation resulting from the interaction of a colloid along with the vaporization of water, whereby the diffusion of the cationic polymer to the upper layer can be limited. As a result, bronzing is suppressed.

Also, when a polyvinyl alcohol having a degree of saponification of 85 or more and 100 or less is used as the binder in the above dispersion process, the gelation of the coating liquid can be promoted in the course of drying. The ability of retaining the cationic polymer of the lower layer can be improved by the interaction of the flocculation in the course of drying.

As to the amount of the polyvinyl alcohol at this time, it is preferable to add the polyvinyl alcohol in an amount of 7% by mass to 12% by mass when the mass of the alumina hydrate is set to 100. When the amount of polyvinyl alcohol is less than 7% by mass, the retaining effect produced by gelation of the polyvinyl alcohol is low, whereas when the amount of the polyvinyl alcohol exceeds 12% by mass, such troubles arise that gelation of the polyvinyl alcohol is promoted, leading to a deterioration in coating adaptability. For this, the amount of the polyvinyl alcohol is 8% by mass or more and 9% by mass or less based on the alumina hydrate in the lower layer in a best embodiment of the present invention.

Also, the ratio of the polyvinyl alcohol to the alumina hydrate is made larger in the lower layer than in the upper layer to more increase the rate of gelation in the lower layer than in the upper layer, thereby causing the lower layer to gel first, with the result that the cationic polymer can be retained in the lower layer without fail. At this time, the rate of gelation may be evaluated by a difference between the viscosity of the coating liquid just after the polyvinyl alcohol is added in a dispersion solution containing the cationic polymer and the alumina hydrate and the viscosity of the coating liquid five minutes after the polyvinyl alcohol is added. In this case, the larger the absolute value of the difference in viscosity is, the higher the rate of gelation is evaluated to be, whereas the smaller the absolute value of the difference in viscosity is, the lower the rate of gelation is evaluated to be. As a consequence, the absolute value of a difference in viscosity between the upper layer and the lower layer is preferably 100 cp or more.

Also from the above results of evaluation, ratio (wt %) of the polyvinyl alcohol to the alumina hydrate is preferably smaller in the upper layer than in the lower layer. In a preferred embodiment of the present invention, the amount of the polyvinyl alcohol in the upper layer is 4% by mass or more to 6% by mass or less when the amount of the alumina hydrate is 100.

(Other Materials)

In the ink receiving layer (upper layer and lower layer), at least one of boric acid and a borate may be added according to the need. The generation of cracks in the ink receiving layer can be prevented by the addition of boric acid or a borate. At this time, examples of the boric acid to be used include, besides orthoboric acid ($H_3BO_3$), methaboric acid and hypoboric acid. The borate is preferably water-soluble salts of the above boric acids. Specific examples of the borate may include alkali earth metal salts of boric acid described below:

Alkali metal salts such as sodium salts of boric acid (for example, $Na_2B_4O_7.10H_2O$ and $NaBO_2.4H_2O$) and potassium salts of boric acid (for example, $K_2B_4O_7.5H_2O$, $KBO_2$)

Ammonium salts of boric acid ($NH_4B_4O_9.3H_2O$ and $NH_4BO_2$)

Magnesium salts or calcium salts of boric acid

Among these boric acids and the like, orthoboric acid is preferably used from the point of the stability of the coating liquid with time and the effect of suppressing the generation of cracks. Also, as to the amount of boric acid to be used, boric acid is preferably added in a range of from 10% by mass or more and 50.0% by mass or less in terms of boric acid solid content based on the binder in the upper and lower layers. When this amount exceeds the above range, there is the case where the stability of the coating liquid with time is deteriorated. Specifically, when an ink absorbent recording medium is produced, the coating liquid is resultantly used for a long period of time. If the amount of boric acid is large, there is the case where the viscosity of the coating liquid is increased and the generation of a gelled product is caused. It is therefore necessary to exchange the coating liquid and to clean the coater head frequently and there is therefore the case where significantly poor productivity is obtained. Moreover, if this amount exceeds the above range, dot-like surface defects are easily caused on the ink receiving layer and there is therefore the case where a uniform and good gloss surface is not obtained. In this case, if the amount of boric acid or the like is in the above range, there is the case where cracks are generated in the ink receiving layer though this depends on production conditions and it is therefore necessary to select the range of the appropriate amount to be used.

The following acids or salts may be added as a pH regulator in a coating liquid for forming the ink receiving layer (upper layer and lower layer):

Formic acid, acetic acid, glycolic acid, oxalic acid, propionic acid, malonic acid, succinic acid, adipic acid, maleic acid, malic acid, tartaric acid, citric acid, benzoic acid and phthalic acid Isophthalic acid, terephthalic acid, glutaric acid, gluconic acid, lactic acid, aspartic acid, glutamic acid, pimelic acid, suberic acid and methansulfonic acid Inorganic acids such as hydrochloric acid, nitric acid and phosphoric acid Salts of the above acids When the alumina hydrate is used as the inorganic pigment particles, a monobasic acid is preferably used to disperse the alumina hydrate in water. It is therefore preferable to use organic acids such as formic acid, acetic acid, glycolic acid and methanesulfonic acid, hydrochloric acid or nitric acid among the above pH regulators.

Also, as other additives for the coating liquid, a pigment dispersant, thickener, fluidity improver, antifoaming agent, foam-limiting agent, surfactant, releasing agent, penetrating agent, coloring pigment and coloring dye may be used. Also, a fluorescent bleaching agent, ultraviolet absorber, antioxidant, antiseptic, mildew-proofing agent, water-proofing agent, dye fixing agent, curing agent, weather proof agent and the like may be added according to the need.

(Coating Method of the Coating Liquid)

In the operation of applying the upper layer coating liquid and the lower layer coating liquid to form the ink receiving layer, the following coating method may be used to form a layer constituted of two or more layers and to obtain a proper coating amount, and these coating liquids are applied by on-machine or off-machine coating.

Coater using various curtain coaters or an extrusion system

Coater using a slide hopper system.

When the coating liquid is applied, the coating liquid may be heated and the coater head may be heated for the purpose of, for example, regulating viscosity of the coating liquid.

For the drying of the coating liquid after the coating liquid is applied, a hot air drier such as linear tunnel drier, arch drier, air loop drier or sign-curve air float drier may be used. Also, an appropriate drier may be optionally selected from driers utilizing infrared rays, heating drier or microwave upon use.

Though the upper layer may be applied separately from the lower layer, it is preferable to apply these layers simultaneously by multi-layer coating in view of production efficiency.

In a best mode of the method of producing a recording medium according to the present invention, the above-described lower layer coating liquid (2) and the above-described upper layer coating liquid (1) are preferably applied to the substrate simultaneously.

As the apparatus used to apply two layers simultaneously, an extrusion type coater, slide beads coater or slide curtain coater may be used. In this embodiment, a two-layer slide die which is a slide beads coater is preferably used.

Figure 2:
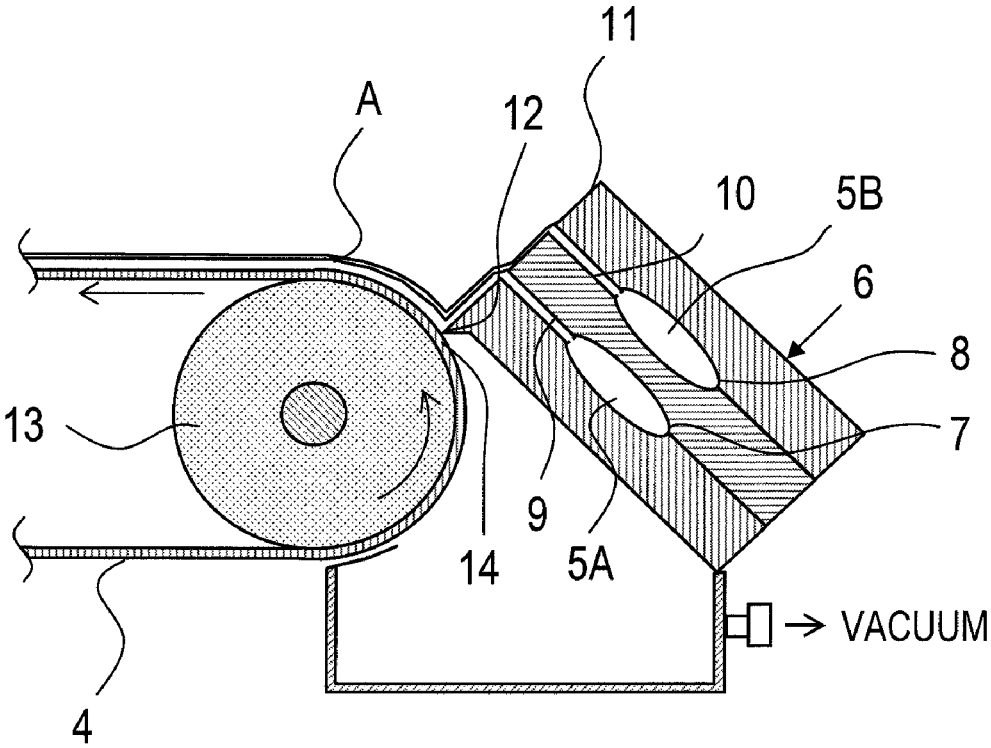
FIG. 2 is an explanatory view of a two-layer slide die.

The two-layer slide die will be explained with reference to FIG. 2.

Plural coating liquids 5A and 5B to be applied to a web 4 are supplied from each coating liquid tank (not shown) to manifolds 7 and 8 respectively in a slide bead 6 for bead coating liquid by each feed pump which is a variable delivery pump. The coating liquids 5A and 5B supplied to the manifolds 7 and 8 are made to flow and broaden in the direction of the coating width so as to be of a predetermined width, then made to pass through slots 9 and 10 respectively and extruded to a slide surface 11 slanted downward on the upper surface of the slide bead 6. Each coating liquid extruded to the slide surface 11 flows downward on the slide surface 11 in the state of a multilayer-coating-film-like multilayer coating liquid and reaches a lip end 12 at the lower end of the slide surface 11. The multilayer coating liquid which has reached the lip end 12 forms a bead part 14 in the space between the lip end 12 and the web surface being wound on the backup roller 13 and traveling. At this time, in order to stabilize the bead part 14, the pressure on the backside of the bead part 14 is reduced by a suction chamber. The multilayer coating liquid in the bead part 14 is subjected to such an action that it is pulled on the surface of the web 4 and stretched into a thin film. As a result, a thin multilayer coating film A can be formed on the traveling web surface 4. Here, 5A represents the lower layer coating liquid and 5B represents the upper layer coating liquid with respect to the slide surface.

In the present invention, interlayer migration of the components included in the upper and lower layers can be prevented by selecting a coating liquid having a proper viscosity and properties and a proper coating method. Since the alumina hydrate and the cationic polymer are included in the lower layer coating liquid, flocculation of both components occurs slowly when the lower layer coating liquid is mixed and dispersed. Also, in the course of drying when the coating liquid is applied, the interaction of colloids along with the vaporization of water causes rapid flocculation of the alumina hydrate and cationic polymer. For this, the cationic polymer can be fixed within the lower layer by the above flocculation during the above dispersion and vaporization-drying in the production process, and therefore, the cationic polymer in the lower layer does not diffuse into the upper layer.

Also, in the present invention, it is preferable to use an alumina hydrate as the inorganic pigments contained in the upper and lower layers and a polyvinyl alcohol as the binders contained in the upper and lower layers.

In this case, the alumina hydrate and binder to be used are respectively the same type and therefore, the upper layer and the lower layer are so tightly stuck to each other that the boundary between both layers is not recognized. These upper and lower layers were produced by bringing both corresponding liquids into contact with each other. Therefore, the diallylamine hydrochloride-sulfur dioxide copolymer to be included in the lower layer was slightly diffused into the upper layer in the vicinity of the boundary of the upper layer and the lower layer as viewed in the thickness direction. However, it was confirmed that the diallylamine hydrochloride-sulfur dioxide copolymer was not present on the surface of the upper layer. This was confirmed by observing no peak at wavelengths of 1300 $cm^{-1}$ and 1130 $cm^{-1}$ showing the presence of a sulfur dioxide part and at wavelengths of 3400 $cm^{-1}$ showing the presence of an amine group when the surface of the recording medium was measured by using a Spectrum One FT-IR Spectrometer manufactured by Perkin Elmer Instruments Co.

(Cyan Ink Dye)

In the year of 2003, the cyan ink dye was generally a phthalocyanine dye represented by the following formula (4) having a structure including plural solubilizing groups such as sodium sulfonate at desired positions.

(4)

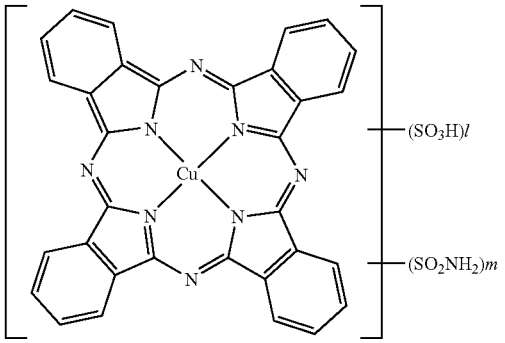

Here, l and m are respectively as follows: l=1 to 2 and m=2 to 3.

As phthalocyanine dyes used after the autumn in 2004 on the other hand, phthalocyanine dyes in which a solubilizing group substituted triazine ring was introduced as the solubilizing group were used to improve the light fastness and gas resistance of them. These current phthalocyanine dyes into which the solubilizing group substituted triazine ring is introduced are used in a preferred embodiment of the present invention.

As the phthalocyanine dye into which the solubilizing group substituted triazine ring is introduced, compounds represented by the following formula (5) may be used.

(5)

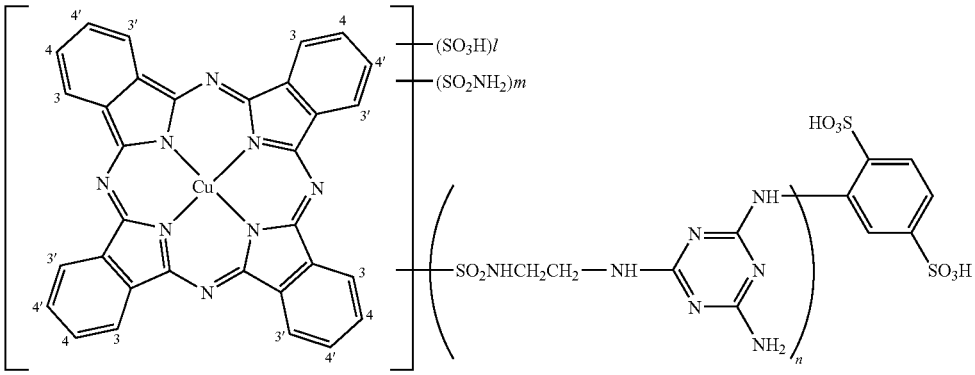

Here, l, m and n are respectively as follows: l=0 to 2, m=1 to 3 and n=1 to 3 (provided that 1+m+n=3 to 4)

(Magenta Ink Dye)

Examples of the anthrapyridone dye include C.I. Acid Red 80, C.I. Acid Red 81, C.I. Acid Red 82, C.I. Acid Red 83 and C.I. Acid Violet 39. Also, dyes represented by the following formula (6) may be given as examples of anthrapyridone dye.

(6)

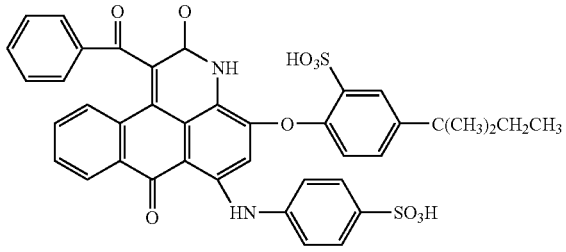

Anthrapyridone dyes exemplified as above are primarily used till the year 2003. After the autumn in 2004 on the other hand, anthrapyridone type dyes in which a solubilizing group substituted triazine ring was introduced as the solubilizing group were used to improve these dyes as shown in the following formula (7).

(7)

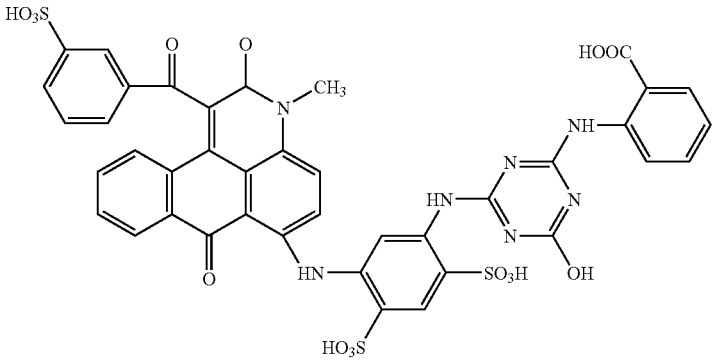

These current anthrapyridone dyes into which the solubilizing group substituted triazine ring is introduced are used in a best embodiment of the present invention.

(Yellow Ink Dye)

As the yellow ink, a general dimer of azo compounds represented by C.I. Direct Yellow 132 (following formula (8)) may be used.

(8)

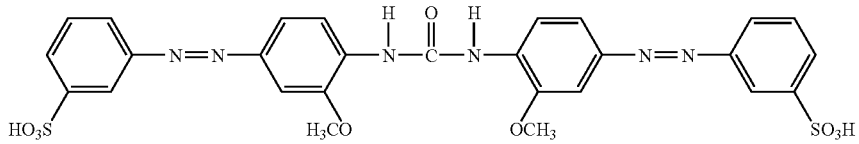

(Black Ink Dye)

A polysazo compound represented by the following formulae (9) and (10) may be used as the black ink.

(9)

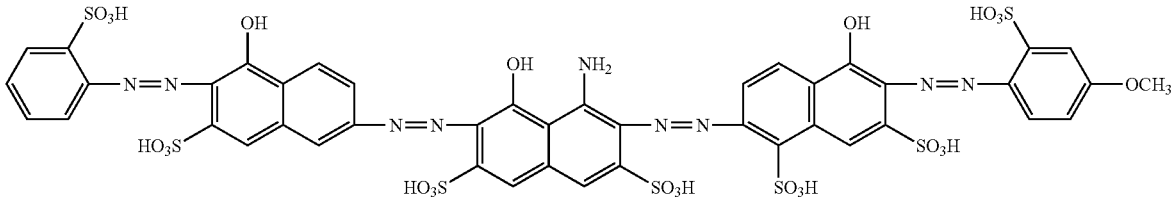

(10)

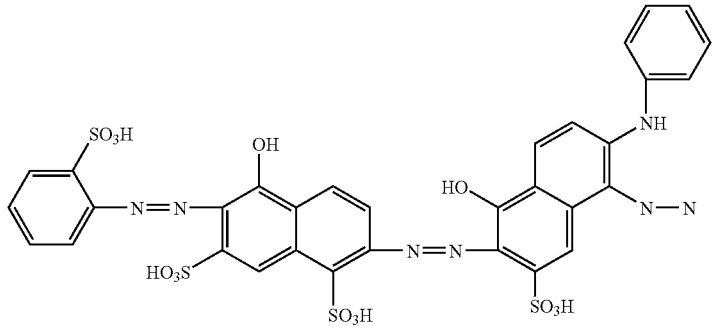

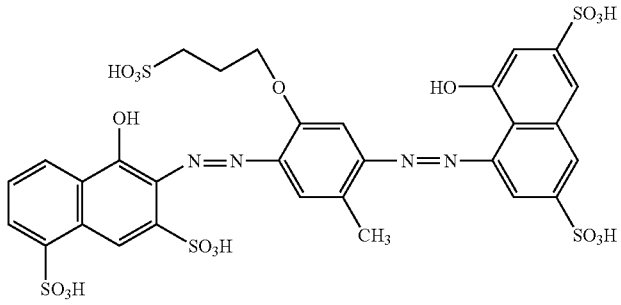

EXAMPLES

The present invention will be explained in more detail by way of examples and comparative examples, which are not intended to limit the present invention.

<Production of a Coating Liquid>

(Production of an Upper-Layer-Forming Coating Liquid A1)

First, an alumina hydrate Disperal HP14 (manufactured by Sasol Co.) was added as inorganic pigment particles in pure water in an amount of 30% by mass. Next, methanesulfonic acid was added to this alumina hydrate such that the ratio (Methanesulfonic acid)/(Inorganic pigment particles)×100 was 1.3% by mass and the mixture was stirred to obtain a colloidal sol. The obtained colloidal sol was appropriately diluted with water such that the content of the alumina hydrate was 27% by mass to obtain a colloidal sol A.

On the other hand, a polyvinyl alcohol PVA235 (manufactured by Kuraray Co., Ltd.) was dissolved in ion exchange water to obtain an aqueous PVA solution having a solid content of 8% by mass. Then, the PVA solution formed above was mixed with the colloidal sol A prepared above such that the solid content of PVA to the solid content of the alumina hydrate, (Binder)/(Inorganic pigment particles)×100, was 5% by mass. Next, an aqueous 3% boric acid solution was mixed in the mixture such that the solid content of boric acid was 1.0% by mass based on the solid content of the alumina hydrate to obtain an upper-layer-forming coating liquid A1.

(Production of an Upper-Layer-Forming Coating Liquid A2)

A coating liquid A2 was produced in the same manner as the coating liquid A1 except that the amount of methanesulfonic acid in the coating liquid A1 was changed to 1.5% by mass.

(Production of an Upper-Layer-Forming Coating Liquid A3)

A coating liquid A3 was produced in the same manner as the coating liquid A1 except that the amount of methanesulfonic acid in the coating liquid A1 was changed to 1.7% by mass.

(Production of an Upper-Layer-Forming Coating Liquid A3-E)

A coating liquid A3-E was produced in the same manner as the coating liquid A3 except that methanesulfonic acid in the coating liquid A3 was changed to ethanesulfonic acid.

(Production of an Upper-Layer-Forming Coating Liquid A3-P)

A coating liquid A3-P was produced in the same manner as the coating liquid A3 except that methanesulfonic acid in the coating liquid A3 was changed to isopropanesulfonic acid.

(Production of an Upper-Layer-Forming Coating Liquid A3-A)

A coating liquid A3-A was produced in the same manner as the coating liquid A3 except that methanesulfonic acid in the coating liquid A3 was changed to acetic acid.

(Production of an Upper-Layer-Forming Coating Liquid A3-G)

A coating liquid A3-G was produced in the same manner as the coating liquid A3 except that methanesulfonic acid in the coating liquid A3 was changed to glyceric acid.

(Production of an Upper-Layer-Forming Coating Liquid A3-H)

A coating liquid A3-H was produced in the same manner as the coating liquid A3 except that methanesulfonic acid in the coating liquid A3 was changed to hexanesulfonic acid.

(Production of an Upper-Layer-Forming Coating Liquid A3-B)

A coating liquid A3-B was produced in the same manner as the coating liquid A3 except that methanesulfonic acid in the coating liquid A3 was changed to benzenesulfonic acid.

(Production of an Upper-Layer-Forming Coating Liquid A4)

A coating liquid A4 was produced in the same manner as the coating liquid A1 except that the amount of methanesulfonic acid in the coating liquid A1 was changed to 1.9% by mass.

(Production of an Upper-Layer-Forming Coating Liquid A5)

A coating liquid A5 was produced in the same manner as the coating liquid A1 except that the amount of methanesulfonic acid in the coating liquid A1 was changed to 2.1% by mass.

(Production of an Upper-Layer-Forming Coating Liquid A6)

A coating liquid A6 was produced in the same manner as the coating liquid A1 except that the amount of methanesulfonic acid in the coating liquid A1 was changed to 1.4% by mass.

(Production of a Lower-Layer-Forming Coating Liquid B2-3)

An alumina hydrate Disperal HP14 (manufactured by Sasol Co.) was added as inorganic pigment particles in pure water in an amount of 30% by mass. Next, methanesulfonic acid was added to this alumina hydrate such that the ratio (Methanesulfonic acid)/(Inorganic pigment particles)×100 was 1.5% by mass. After that, a diallylamine hydrochloride-sulfur dioxide copolymer (trade name: PAS-92, manufactured by Nittobo Co.), molecular mass: 5000) was added to the mixture such that the ratio (Diallylamine hydrochloride-sulfur dioxide copolymer)/(Inorganic pigment particles)×100 was 0.5% by mass with respect to the alumina hydrate. Then, the mixture was stirred to obtain a colloidal sol. The obtained colloidal sol was appropriately diluted with water such that the content of the alumina hydrate was 27% by mass to obtain a colloidal sol A.

On the other hand, a polyvinyl alcohol PVA235 (manufactured by Kuraray Co., Ltd.) was dissolved in ion exchanged water to obtain an aqueous PVA solution having a solid content of 8% by mass. Then, the PVA solution formed above was mixed with the colloidal sol A prepared above such that the solid content of PVA to the solid content of the alumina hydrate, (Binder)/(Inorganic pigment particles)×100, was 8% by mass. Next, an aqueous 3% boric acid solution was mixed in the mixture such that the solid content of boric acid was 1.7% by mass based on the solid content of the alumina hydrate to obtain a lower ink-receiving layer coating liquid B2-3.

(Production of a Lower-Layer-Forming Coating Liquid B1-1)

A coating liquid B1-3 was produced in the same manner as the coating liquid B2-3 except that the amount of methanesulfonic acid in the coating liquid B2-3 was changed to 1.3% by mass and the amount of the diallylamine hydrochloride-sulfur dioxide copolymer was changed to 0.1% by mass.

(Production of a Lower-Layer-Forming Coating Liquid B1-3)

A coating liquid B1-3 was produced in the same manner as the coating liquid B2-3 except that the amount of methanesulfonic acid in the coating liquid B2-3 was changed to 1.3% by mass.

(Production of a Lower-Layer-Forming Coating Liquid B1-5)

A coating liquid B1-5 was produced in the same manner as the coating liquid B1-1 except that the amount of the diallylamine hydrochloride-sulfur dioxide copolymer in the coating liquid B1-1 was changed to 1.0% by mass.

(Production of a Lower-Layer-Forming Coating Liquid B3-3)

A coating liquid B3-3 was produced in the same manner as the coating liquid B2-3 except that the amount of methanesulfonic acid in the coating liquid B2-3 was changed to 1.7% by mass.

(Production of a Lower-Layer-Forming Coating Liquid B4-3)

A coating liquid B4-3 was produced in the same manner as the coating liquid B2-3 except that the amount of methanesulfonic acid in the coating liquid B2-3 was changed to 1.9% by mass.

(Production of a Lower-Layer-Forming Coating Liquid B5-3)

A coating liquid B5-3 was produced in the same manner as the coating liquid B2-3 except that the amount of methanesulfonic acid in the coating liquid B2-3 was changed to 2.1% by mass.

(Production of a Lower-Layer-Forming Coating Liquid B2-4)

A coating liquid B2-4 was produced in the same manner as the coating liquid B2-3 except that the amount of the diallylamine hydrochloride-sulfur dioxide copolymer in the coating liquid B2-3 was changed to 0.75% by mass.

(Production of a Lower-Layer-Forming Coating Liquid B3-4)

A coating liquid B3-4 was produced in the same manner as the coating liquid B3-3 except that the amount of the diallylamine hydrochloride-sulfur dioxide copolymer in the coating liquid B3-3 was changed to 0.75% by mass.

(Production of a Lower-Layer-Forming Coating Liquid B4-4)

A coating liquid B4-4 was produced in the same manner as the coating liquid B4-3 except that the amount of the diallylamine hydrochloride-sulfur dioxide copolymer in the coating liquid B4-3 was changed to 0.75% by mass.

(Production of a Lower-Layer-Forming Coating Liquid B5-4)

A coating liquid B5-4 was produced in the same manner as the coating liquid B5-3 except that the amount of the diallylamine hydrochloride-sulfur dioxide copolymer in the coating liquid B5-3 was changed to 0.75% by mass.

(Production of a Lower-Layer-Forming Coating Liquid B5-5)

A coating liquid B5-5 was produced in the same manner as the coating liquid B5-4 except that the amount of the diallylamine hydrochloride-sulfur dioxide copolymer in the coating liquid B5-4 was changed to 1.00% by mass.

(Production of a Lower-Layer-Forming Coating Liquid B4-5)

A coating liquid B4-5 was produced in the same manner as the coating liquid B4-4 except that the amount of the diallylamine hydrochloride-sulfur dioxide copolymer in the coating liquid B4-4 was changed to 1.00% by mass.

(Production of a Lower-Layer-Forming Coating Liquid C3-3)

A coating liquid C3-3 was produced in the same manner as the coating liquid B3-3 except that the amount of the diallylamine hydrochloride-sulfur dioxide copolymer in the coating liquid B3-3 was changed to a polyallylamine hydrochloride (trade name: PAA-HCL-05, manufactured by Nittobo Co.).

(Production of a Lower-Layer-Forming Coating Liquid D3-3)

A coating liquid D3-3 was produced in the same manner as the coating liquid B3-3 except that the diallylamine hydrochloride-sulfur dioxide copolymer in the coating liquid B3-3 was changed to a methyldiallylamine hydrochloride polymer (trade name: PAS-M-1L, manufactured by Nittobo Co.).

(Production of a Lower-Layer-Forming Coating Liquid B3-1-E)

A coating liquid B-3-1-E was produced in the same manner as the coating liquid B3-3 except that methanesulfonic acid in the coating liquid B3-3 was changed to ethanesulfonic acid.

(Production of a Lower-Layer-Forming Coating Liquid B3-1-P)

A coating liquid B-3-1-P was produced in the same manner as the coating liquid B3-3 except that methanesulfonic acid in the coating liquid B3-3 was changed to isopropanesulfonic acid.

(Production of a Lower-Layer-Forming Coating Liquid B3-1-A)

A coating liquid B-3-1-A was produced in the same manner as the coating liquid B3-3 except that methanesulfonic acid in the coating liquid B3-3 was changed to acetic acid.

(Production of a Lower-Layer-Forming Coating Liquid B3-1-G)

A coating liquid B-3-1-G was produced in the same manner as the coating liquid B3-3 except that methanesulfonic acid in the coating liquid B3-3 was changed to glyceric acid.

(Production of a Lower-Layer-Forming Coating Liquid B3-1-H)

A coating liquid B-3-1-H was produced in the same manner as the coating liquid B3-3 except that methanesulfonic acid in the coating liquid B3-3 was changed to hexanesulfonic acid.

(Production of a Lower-Layer-Forming Coating Liquid B3-1-B)

A coating liquid B-3-1-B was produced in the same manner as the coating liquid B3-3 except that methanesulfonic acid in the coating liquid B3-3 was changed to benzenesulfonic acid.

(Production of a Lower-Layer-Forming Coating Liquid A1-0)

A coating liquid A1-0 was produced in the same manner as the coating liquid B1-5 except that the diallylamine hydrochloride-sulfur dioxide copolymer was excluded from the above coating liquid B1-5.

(Production of a Lower-Layer-Forming Coating Liquid A5-0)

A coating liquid A5-0 was produced in the same manner as the coating liquid B5-3 except that the diallylamine hydrochloride-sulfur dioxide copolymer was excluded from the above coating liquid B5-3.

<Production of a Substrate>

A substrate was prepared in the following manner.

First, a paper material having the following composition was prepared:

Pulp slurry 100 parts by mass

Laulholz bleached kraft pulp (LBKP) having a CSF freeness of 450 ml (CSF: Canadian Standard Freeness): 80 parts by mass Nadelhoz bleached kraft pulp (NBKP) having a CDF freeness of 480 ml: 20 parts by mass Cationic starch 0.60 parts by mass Heavy calcium carbonate 10 parts by mass Precipitated calcium carbonate 15 parts by mass Alkyl ketene dimer 0.10 parts by mass Cationic polyacrylamide 0.03 parts by mass Next, this paper material was subjected to paper making with a Fourdrinier paper machine in which three-stage wet pressing was conducted followed by drying with a multi-cylinder drier. After that, the resultant paper was impregnated with an aqueous oxidized starch solution such that the solid content was 1.0 g/m$^2$ by using a sizing press machine and then dried. Then, the paper was subjected to a calendering machine for finishing to obtain a base paper A having a basis weight of 170 g/m$^2$, a Stockigt sizing degree of 100 sec., an air permeability of 50 sec., a Bekk smoothness of 30 sec., and a Gurley hardness of 11.0 mN. A resin composition including a low-density polyethylene (70 parts by mass), a high-density polyethylene (20 parts by mass) and titanium oxide (10 parts by mass) was applied onto the base paper A in an amount of 25 g/m$^2$. Furthermore, a resin composition including a high-density polyethylene (50 parts by mass) and a low-density polyethylene (50 parts by mass) was applied onto the back surface in an amount of 25 g/m$^2$ to obtain a resin-coated substrate 1.

Example 1

The upper-layer-forming coating liquid A2 and lower-layer-forming coating liquid B2-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 2

The upper-layer-forming coating liquid A2 and lower-layer-forming coating liquid B2-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 3

The upper-layer-forming coating liquid A6 and lower-layer-forming coating liquid B2-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 4

The upper-layer-forming coating liquid A3 and lower-layer-forming coating liquid B3-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 5

The upper-layer-forming coating liquid A3 and lower-layer-forming coating liquid C3-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 6

The upper-layer-forming coating liquid A3 and lower-layer-forming coating liquid D3-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 7

The upper-layer-forming coating liquid A4 and lower-layer-forming coating liquid B4-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 8

The upper-layer-forming coating liquid A5 and lower-layer-forming coating liquid B5-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 9

The upper-layer-forming coating liquid A2 and lower-layer-forming coating liquid B2-4 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 10

The upper-layer-forming coating liquid A3 and lower-layer-forming coating liquid B3-4 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 11

The upper-layer-forming coating liquid A4 and lower-layer-forming coating liquid B4-4 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 12

The upper-layer-forming coating liquid A5 and lower-layer-forming coating liquid B5-4 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 13

The upper-layer-forming coating liquid A5 and lower-layer-forming coating liquid B5-5 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 14

The upper-layer-forming coating liquid A4 and lower-layer-forming coating liquid B4-5 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 15

The upper-layer-forming coating liquid A3-E and lower-layer-forming coating liquid B3-1-E described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Example 16

The upper-layer-forming coating liquid A3-P and lower-layer-forming coating liquid B3-1-P described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Comparative Example 1

The lower-layer-forming coating liquid A1-0 described in Table 2 was applied to the above substrate 1 in such a dry thickness as described in Table 2. The coating was performed by heating the coating liquid to 40° C. and by applying it using a two-layer slide die. Thereafter, the applied liquid was dried at 40° C. to manufacture an ink jet recording medium.

Comparative Example 2

The lower-layer-forming coating liquid A5-0 described in Table 2 was applied to the above substrate 1 in such a dry thickness as described in Table 2. The coating was performed by heating the coating liquid to 40° C. and by applying it using a two-layer slide die. Thereafter, the applied liquid was dried at 40° C. to manufacture an ink jet recording medium.

Comparative Example 3

The lower-layer-forming coating liquid B1-5 described in Table 2 was applied to the above substrate 1 in such a dry thickness as described in Table 2. The coating was performed by heating the coating liquid to 40° C. and by applying it using a two-layer slide die. Thereafter, the applied liquid was dried at 40° C. to manufacture an ink jet recording medium.

Comparative Example 4

The lower-layer-forming coating liquid B1-3 described in Table 2 was applied to the above substrate 1 in such a dry thickness as described in Table 2. The coating was performed by heating the coating liquid to 40° C. and by applying it using a two-layer slide die. Thereafter, the applied liquid was dried at 40° C. to manufacture an ink jet recording medium.

Comparative Example 5

The lower-layer-forming coating liquid B1-1 described in Table 2 was applied to the above substrate 1 in such a dry thickness as described in Table 2. The coating was performed by heating the coating liquid to 40° C. and by applying it using a two-layer slide die. Thereafter, the applied liquid was dried at 40° C. to manufacture an ink jet recording medium.

Comparative Example 6

The upper-layer-forming coating liquid A1 and lower-layer-forming coating liquid B1-3 described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Comparative Example 7

The upper-layer-forming coating liquid A3-A and lower-layer-forming coating liquid B3-1-A described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Comparative Example 8

The upper-layer-forming coating liquid A3-G and lower-layer-forming coating liquid B3-1-G described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Comparative Example 9

The upper-layer-forming coating liquid A3-H and lower-layer-forming coating liquid B3-1-H described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

Comparative Example 10

The upper-layer-forming coating liquid A3-B and lower-layer-forming coating liquid B3-1-B described in Tables 1 and 2 were applied in this order to the above substrate 1 by simultaneous multilayer coating in such dry thicknesses as described in Tables 1 and 2. The coating was performed by heating each coating liquid to 40° C. and by applying it using a two-layer slide die. Thereafter, the applied liquid was dried at 40° C. to manufacture an ink jet recording medium.

The manufacturing conditions of the above Examples 1 to 16 and Comparative Examples 1 to 10 are shown in Tables 1 to 3.

TABLE 1

| | Upper Layer | | | | | | |
|---|---|---|---|---|---|---|---|
| | | Acid | | PVA | Boric Acid | | Upper |
| | Alumina | Mass % based on Alumina | Acid Type | Mass % based on Alumina | Mass % based on Alumina | Dry Film Thickness μm | Layer Coating Liquid |
| Example 1 | 100 | 1.5 | Methanesulfonic Acid | 5 | 1.7 | 5 | Coating Liquid A2 |
| Example 2 | 100 | 1.5 | Methanesulfonic Acid | 5 | 1.7 | 10 | Coating Liquid A2 |
| Example 3 | 100 | 1.4 | Methanesulfonic Acid | 5 | 1.7 | 10 | Coating Liquid A6 |
| Example 4 | 100 | 1.7 | Methanesulfonic Acid | 5 | 1.7 | 5 | Coating Liquid A3 |
| Example 5 | 100 | 1.7 | Methanesulfonic Acid | 5 | 1.7 | 5 | Coating Liquid A3 |
| Example 6 | 100 | 1.7 | Methanesulfonic Acid | 5 | 1.7 | 5 | Coating Liquid A3 |
| Example 7 | 100 | 1.9 | Methanesulfonic Acid | 5 | 1.7 | 5 | Coating Liquid A4 |
| Example 8 | 100 | 2.1 | Methanesulfonic Acid | 5 | 1.7 | 5 | Coating Liquid A5 |
| Example 9 | 100 | 1.5 | Methanesulfonic Acid | 5 | 1.7 | 5 | Coating Liquid A2 |
| Example 10 | 100 | 1.7 | Methanesulfonic Acid | 5 | 1.7 | 5 | Coating Liquid A3 |
| Example 11 | 100 | 1.9 | Methanesulfonic Acid | 5 | 1.7 | 5 | Coating Liquid A4 |
| Example 12 | 100 | 2.1 | Methanesulfonic Acid | 5 | 1.7 | 5 | Coating Liquid A5 |
| Example 13 | 100 | 2.1 | Methanesulfonic Acid | 5 | 1.7 | 5 | Coating Liquid A5 |
| Example 14 | 100 | 1.9 | Methanesulfonic Acid | 5 | 1.7 | 5 | Coating Liquid A4 |
| Example 15 | 100 | 1.7 | Ethanesulfonic Acid | 5 | 1.7 | 5 | Coating Liquid A3-E |
| Example 16 | 100 | 1.7 | Isopropanesulfonic Acid | 5 | 1.7 | 5 | Coating Liquid A3-P |
| Comparative Example 1 | 0 | 0 | | 0 | 0 | 0 | None |
| Comparative Example 2 | 0 | 0 | | 0 | 0 | 0 | None |
| Comparative Example 3 | 0 | 0 | | 0 | 0 | 0 | None |
| Comparative Example 4 | 0 | 0 | | 0 | 0 | 0 | None |
| Comparative Example 5 | 0 | 0 | | 0 | 0 | 0 | None |
| Comparative Example 6 | 100 | 1.3 | Methanesulfonic Acid | 5 | 1.7 | 5 | Coating Liquid A1 |
| Comparative Example 7 | 100 | 1.7 | Acetic Acid | 5 | 1.7 | 5 | Coating Liquid A3-A |
| Comparative Example 8 | 100 | 1.7 | Glyceric Acid | 5 | 1.7 | 5 | Coating Liquid A3-G |

TABLE 1-continued

| | Upper Layer | | | | | | |
|---|---|---|---|---|---|---|---|
| | | Acid | | PVA | Boric Acid | | Upper |
| | Alumina | Mass % based on Alumina | Acid Type | Mass % based on Alumina | Mass % based on Alumina | Dry Film Thickness μm | Layer Coating Liquid |
| Comparative Example 9 | 100 | 1.7 | Hexanesulfonic Acid | 5 | 1.7 | 5 | Coating Liquid A3-H |
| Comparative Example 10 | 100 | 1.7 | Benzenesulfonic Acid | 5 | 1.7 | 5 | Coating Liquid A3-B |

Each content of the acid, PVA (polyvinyl alcohol) and boric acid in the above Table 1 shows mass % when the mass of the alumina hydrate is defined as 100.

TABLE 2

| | Lower Layer | | | | | | | | | |
|---|---|---|---|---|---|---|---|---|---|---|
| | | Acid | | | | | Cation | | | |
| | Alumina | Mass % based on Alumina | Acid Type | PVA Mass % based on Alumina | Boric Acid Mass % based on Alumina | Mass % based on Alumina | Type | Average Molecular Mass | Dry Film Thickness μm | Lower Layer Coating Amount |
| Example 1 | 100 | 1.5 | Methanesulfonic Acid | 8 | 1.7 | 0.5 | Diallylamine Hydrochloride-Sulfur Dioxide Copolymer | 5000 | 30 | Coating Liquid B2-3 |
| Example 2 | 100 | 1.5 | Methanesulfonic Acid | 8 | 1.7 | 0.5 | Diallylamine Hydrochloride-Sulfur Dioxide Copolymer | 5000 | 20 | Coating Liquid B2-3 |
| Example 3 | 100 | 1.5 | Methanesulfonic Acid | 8 | 1.7 | 0.5 | Diallylamine Hydrochloride-Sulfur Dioxide Copolymer | 5000 | 20 | Coating Liquid B2-3 |
| Example 4 | 100 | 1.7 | Methanesulfonic Acid | 8 | 1.7 | 0.5 | Diallylamine Hydrochloride-Sulfur Dioxide Copolymer | 5000 | 30 | Coating Liquid B3-3 |
| Example 5 | 100 | 1.7 | Methanesulfonic Acid | 8 | 1.7 | 0.5 | Polyallylamine Hydrochloride | 5000 | 30 | Coating Liquid C3-3 |
| Example 6 | 100 | 1.7 | Methanesulfonic Acid | 8 | 1.7 | 0.5 | Methyldiallylamine Hydrochloride-Sulfur Dioxide Copolymer | 5000 | 30 | Coating Liquid D3-3 |
| Example 7 | 100 | 1.9 | Methanesulfonic Acid | 8 | 1.7 | 0.5 | Diallylamine Hydrochloride-Sulfur Dioxide Copolymer | 5000 | 30 | Coating Liquid B4-3 |
| Example 8 | 100 | 2.1 | Methanesulfonic Acid | 8 | 1.7 | 0.5 | Diallylamine Hydrochloride-Sulfur Dioxide Copolymer | 5000 | 30 | Coating Liquid B5-3 |
| Example 9 | 100 | 1.5 | Methanesulfonic Acid | 8 | 1.7 | 0.75 | Diallylamine Hydrochloride-Sulfur Dioxide Copolymer | 5000 | 30 | Coating Liquid B2-4 |
| Example 10 | 100 | 1.7 | Methanesulfonic Acid | 8 | 1.7 | 0.75 | Diallylamine Hydrochloride-Sulfur Dioxide Copolymer | 5000 | 30 | Coating Liquid B3-4 |
| Example 11 | 100 | 1.9 | Methanesulfonic Acid | 8 | 1.7 | 0.75 | Diallylamine Hydrochloride-Sulfur Dioxide Copolymer | 5000 | 30 | Coating Liquid B4-4 |
| Example 12 | 100 | 2.1 | Methanesulfonic Acid | 8 | 1.7 | 0.75 | Diallylamine Hydrochloride-Sulfur Dioxide Copolymer | 5000 | 30 | Coating Liquid B5-4 |
| Example 13 | 100 | 2.1 | Methanesulfonic Acid | 8 | 1.7 | 1.0 | Diallylamine Hydrochloride-Sulfur Dioxide Copolymer | 5000 | 30 | Coating Liquid B5-5 |
| Example 14 | 100 | 1.9 | Methanesulfonic Acid | 8 | 1.7 | 1.0 | Diallylamine Hydrochloride-Sulfur Dioxide Copolymer | 5000 | 30 | Coating Liquid B4-5 |

TABLE 2-continued

| | Lower Layer | | | | | | | | | |
|---|---|---|---|---|---|---|---|---|---|---|
| | | Acid | | | | Cation | | | | |
| | Alumina | Mass % based on Alumina | Acid Type | PVA Mass % based on Alumina | Boric Acid Mass % based on Alumina | Mass % based on Alumina | Type | Average Molecular Mass | Dry Film Thickness μm | Lower Layer Coating Amount |
| Example 15 | 100 | 1.7 | Ethanesulfonic Acid | 8 | 1.7 | 0.5 | Diallylamine Hydrochloride-Sulfur Dioxide Copolymer | 5000 | 30 | Coating Liquid B3-1-E |
| Example 16 | 100 | 1.7 | Isopropanesulfonic Acid | 8 | 1.7 | 0.5 | Diallylamine Hydrochloride-Sulfur Dioxide Copolymer | 5000 | 30 | Coating Liquid B3-1-P |
| Comparative Example 1 | 100 | 1.3 | Methanesulfonic Acid | 8 | 1.7 | 0 | Diallylamine Hydrochloride-Sulfur Dioxide Copolymer | 5000 | 35 | Coating Liquid A1-0 |
| Comparative Example 2 | 100 | 2.1 | Methanesulfonic Acid | 8 | 1.7 | 0 | Diallylamine Hydrochloride-Sulfur Dioxide Copolymer | 5000 | 35 | Coating Liquid A5-0 |
| Comparative Example 3 | 100 | 1.3 | Methanesulfonic Acid | 8 | 1.7 | 1.0 | Diallylamine Hydrochloride-Sulfur Dioxide Copolymer | 5000 | 35 | Coating Liquid B1-5 |
| Comparative Example 4 | 100 | 1.3 | Methanesulfonic Acid | 8 | 1.7 | 0.5 | Diallylamine Hydrochloride-Sulfur Dioxide Copolymer | 5000 | 35 | Coating Liquid B1-3 |
| Comparative Example 5 | 100 | 1.3 | Methanesulfonic Acid | 8 | 1.7 | 0.1 | Diallylamine Hydrochloride-Sulfur Dioxide Copolymer | 5000 | 35 | Coating Liquid B1-1 |
| Comparative Example 6 | 100 | 1.3 | Methanesulfonic Acid | 8 | 1.7 | 0.5 | Diallylamine Hydrochloride-Sulfur Dioxide Copolymer | 5000 | 30 | Coating Liquid B1-3 |
| Comparative Example 7 | 100 | 1.7 | Acetic Acid | 8 | 1.7 | 0.5 | Diallylamine Hydrochloride-Sulfur Dioxide Copolymer | 5000 | 30 | Coating Liquid B3-1-A |
| Comparative Example 8 | 100 | 1.7 | Glyceric Acid | 8 | 1.7 | 0.5 | Diallylamine Hydrochloride-Sulfur Dioxide Copolymer | 5000 | 30 | Coating Liquid B3-1-G |
| Comparative Example 9 | 100 | 1.7 | Hexanesulfonic Acid | 8 | 1.7 | 0.5 | Diallylamine Hydrochloride-Sulfur Dioxide Copolymer | 5000 | 30 | Coating Liquid B3-1-H |
| Comparative Example 10 | 100 | 1.7 | Benzenesulfonic Acid | 8 | 1.7 | 0.5 | Diallylamine Hydrochloride-Sulfur Dioxide Copolymer | 5000 | 30 | Coating Liquid B3-1-B |

Each content of the acid, PVA (polyvinyl alcohol), boric acid and cationic polymer in the above Table 2 shows mass % when the mass of the alumina hydrate is defined as 100.

TABLE 3

| | Upper and Lower Layers | | | | | | |
|---|---|---|---|---|---|---|---|
| | | | Total Amount of Acids | | Total Amount of Cationic Polymers | | Acids and Cations |
| | Layer Thickness μm | Total Amount of Alumina $g/m^2$ | Mass % based on Alumina | $g/m^2$ | Mass % based on Alumina | $g/m^2$ | Mass % based on Alumina |
| Example 1 | 35 | 31.48 | 1.50 | 0.47 | 0.43 | 0.13 | 1.93 |
| Example 2 | 30 | 27.15 | 1.50 | 0.41 | 0.33 | 0.09 | 1.83 |
| Example 3 | 30 | 27.16 | 1.47 | 0.40 | 0.33 | 0.09 | 1.80 |
| Example 4 | 35 | 31.42 | 1.70 | 0.53 | 0.43 | 0.13 | 2.13 |
| Example 5 | 35 | 31.42 | 1.70 | 0.53 | 0.43 | 0.13 | 2.13 |
| Example 6 | 35 | 31.42 | 1.70 | 0.53 | 0.43 | 0.13 | 2.13 |
| Example 7 | 35 | 31.37 | 1.90 | 0.60 | 0.43 | 0.13 | 2.33 |
| Example 8 | 35 | 31.31 | 2.10 | 0.66 | 0.43 | 0.13 | 2.53 |
| Example 9 | 35 | 31.42 | 1.50 | 0.47 | 0.64 | 0.20 | 2.14 |
| Example 10 | 35 | 31.36 | 1.70 | 0.53 | 0.64 | 0.20 | 2.34 |

TABLE 3-continued

| | Upper and Lower Layers | | | | | | |
|---|---|---|---|---|---|---|---|
| | | | Total Amount of Acids | | Total Amount of Cationic Polymers | | Acids and Cations |
| | Layer Thickness μm | Total Amount of Alumina g/m$^2$ | Mass % based on Alumina | g/m$^2$ | Mass % based on Alumina | g/m$^2$ | Mass % based on Alumina |
| Example 11 | 35 | 31.31 | 1.90 | 0.59 | 0.64 | 0.20 | 2.54 |
| Example 12 | 35 | 31.25 | 2.10 | 0.66 | 0.64 | 0.20 | 2.74 |
| Example 13 | 35 | 31.19 | 2.10 | 0.66 | 0.85 | 0.27 | 2.95 |
| Example 14 | 35 | 31.25 | 1.90 | 0.59 | 0.85 | 0.27 | 2.75 |
| Example 15 | 35 | 31.42 | 1.70 | 0.53 | 0.43 | 0.13 | 2.13 |
| Example 16 | 35 | 31.42 | 1.70 | 0.53 | 0.43 | 0.13 | 2.13 |
| Comparative Example 1 | 35 | 31.53 | 0.00 | 0.00 | 0.00 | 0.00 | 0.00 |
| Comparative Example 2 | 35 | 31.31 | 0.00 | 0.00 | 0.00 | 0.00 | 0.00 |
| Comparative Example 3 | 35 | 31.25 | 1.30 | 0.41 | 1.00 | 0.31 | 1.61 |
| Comparative Example 4 | 35 | 31.39 | 1.30 | 0.41 | 0.50 | 0.16 | 1.46 |
| Comparative Example 5 | 35 | 31.50 | 1.30 | 0.41 | 0.10 | 0.03 | 1.33 |
| Comparative Example 6 | 35 | 31.54 | 1.30 | 0.41 | 0.43 | 0.13 | 1.43 |
| Comparative Example 7 | 35 | 31.42 | 1.70 | 0.53 | 0.43 | 0.13 | 2.13 |
| Comparative Example 8 | 35 | 31.42 | 1.70 | 0.53 | 0.43 | 0.13 | 2.13 |
| Comparative Example 9 | 35 | 31.42 | 1.70 | 0.53 | 0.43 | 0.13 | 2.13 |
| Comparative Example 10 | 35 | 31.42 | 1.70 | 0.53 | 0.43 | 0.13 | 2.13 |

"Layer thickness", "Total amount of alumina", "Total amount of acids", "Total amount of cationic polymers" and "Content of acids+cationic polymers" in the above Table 3 represent the total amount in the upper layer and lower layer.

Also, "Total amount of acids", "Total amount of cationic polymers" and "Content of acids+cationic polymers" each represent mass % when the mass of the alumina hydrate is defined as 100.

The pH of the ink-receiving layer of each ink jet recording medium manufactured in Examples 1 to 16 and Comparative Examples 1 to 10 was measured, to find that the pH of each layer was 5.0.

The ink-receiving layer of each ink jet recording medium manufactured in Examples 1 to 16 and Comparative Examples 1 to 10 was evaluated in the following evaluation methods.

<Evaluation Methods>

(1) Bronzing

A cyan solid image was printed on the ink jet recording medium by using an ink jet printer (trade name: PIXUS iP7500, manufactured by Canon Inc.) at the following 13 different duties:—5, 12, 21, 29, 35, 43, 51, 58, 66, 74, 85, 90 and 100%.

With regard to this printed product, the duty at which a bronzing phenomenon began to occur was visually evaluated and its duty was defined as bronzing-occurrence duty. It is said that the higher the bronzing occurrence duty is, the more resistant to bronzing the ink jet recording medium is. Each recording medium was evaluated with the thus-obtained bronzing occurrence duty based on the following evaluation criteria.

Evaluation Criteria

5: Bronzing occurrence duty: 90% or more (it is not visually recognized whether bronzing occurs or not).

4: Bronzing occurrence duty: 85% or more and less than 90%.

3: Bronzing occurrence duty: 74% or more and less than 85%.

2: Bronzing occurrence duty: 58% or more and less than 74%.

1: Bronzing occurrence duty: less than 58% (occurrence of bronzing is visually recognized in an actual image).

(2) Migration of Magenta

An ink jet printer (trade name: iP7500, manufactured by Canon Inc.) was used to reversely print a 20-point Japanese letter "田" at 20 places in a blue solid image on the recording medium. Thereafter, the recording medium was stored in the circumstance of 30° C. and 90% R.H. for one week and then, the rate of bleeding of magenta into the reversely printed parts was visually evaluated based on the following evaluation criteria.

Evaluation Criteria

5: A level at which the bleeding of magenta into the white ground parts is not observed at all.

4: A level at which the bleeding of magenta into the white ground parts is observed but it is not visually confirmed that the line width of the letter is narrowed.

3: A level at which the bleeding of magenta into the white ground parts is observed and it is visually confirmed that the line width of the letter is one-half or more of that obtained before the recording medium is stored.

2: A level at which the bleeding of magenta into the white ground parts is observed and it is visually confirmed that the line width of the letter is one-half or less of that obtained before the recording medium is stored, but the printed letters can be visually recognized.

1: A level at which magenta bleeds on the entire surface of the reversely printed parts, so that the printed letters are not recognized at all, posing practical problems.

(3) Color Stability

An ink jet printer (trade name: PIXUS iP7500, manufactured by Canon Inc.) was used to print a black solid image on the ink jet recording medium. Then, a color difference (ΔE) between a color obtained just after the printing was finished and a color obtained after the recording medium was allowed to stand for five minutes after the printing was finished was measured using a spectrophotometer (trade name: Specrotrino, manufactured by Gretag Macbeth Company).

5: ΔE is less than 2 (a level at which no bleeding occurs even if the recording medium is put in, for example, a clear file or an album just after printing)

4: ΔE is 2 or more and less than 3 (a level at which bleeding occurs when the recording medium is put in, for example, a clear file or an album just after printing, but this bleeding is not visually recognized on an actual image).

3: ΔE is 3 or more and less than 4 (a level at which bleeding occurs when the recording medium is put in, for example, a clear file or an album just after printing, but this bleeding is visually allowable on an actual image).

2: ΔE is 4 or more and less than 5 (a level at which bleeding occurs when the recording medium is put in, for example, a clear file or an album just after printing, but this bleeding is visually allowable if the image is a margin-free image).

1: ΔE is 5 or more (a level at which bleeding occurs when the recording medium is put in, for example, a clear file or an album just after printing, posing a quality problem).

(4) Image Density

A black solid image was printed on the ink jet recording medium by an ink jet printer (trade name: iP7500, manufactured by Canon Inc.) with a super photo-paper mode (setting of a default). After that, the reflection density of the black-printed part was measured by 310 TR manufactured by X-Rite Company.

(5) Yellowing

The ink jet recording medium was stored in the same storing conditions as those corresponding to the storing environment for the term during which a general ink jet recording medium product was delivered to stores after it was manufactured (physical distribution term). As the above physical distribution storing condition, the equivalent conditions as those under which the ink jet recording medium was transported to Amsterdam by marine transportation after it was manufactured in Japan was set.

Specifically, the ink jet recording medium was put into a PET film container and stored in an environment of 50° C. and 80% R.H. for 10 days. After that, a 50 mm×10 mm part which was a white background of a test piece and was taken out of the resin file was measured with a spectrophotometer (trade name: Specrotrino, manufactured by Gretag Macbeth Company). A difference between this density of the white background and the density of the background before storing the test piece was used to evaluate the level of yellowing of the white background according to the following criteria.

Evaluation Criteria

White background yellowing level (Δb*)=b* before storing the test piece−b* after storing the test piece A: Δ*≦2 No yellowing is visually observed, good level.

B: 2<Δb*≦3 Yellowing is at such a level that it is not minded at all.

C: 3<Δb*≦6 Yellowing is visually observed but is practically at the lowest allowable level.

The results obtained above are shown in Table 4.

TABLE 4

| | Effect | | | | |
|---|---|---|---|---|---|
| | Bronzing | Migration | Color Stability | OD | Yellowing |
| Example 1 | 5 | 4 | 4 | 2.5 | A |
| Example 2 | 5 | 4 | 4 | 2.5 | A |
| Example 3 | 5 | 4 | 4 | 2.5 | A |
| Example 4 | 5 | 5 | 5 | 2.5 | A |
| Example 5 | 5 | 4 | 4 | 2.5 | B |
| Example 6 | 5 | 4 | 4 | 2.5 | B |
| Example 7 | 5 | 5 | 5 | 2.5 | A |
| Example 8 | 4 | 5 | 5 | 2.5 | A |
| Example 9 | 5 | 4 | 4 | 2.5 | A |
| Example 10 | 5 | 5 | 5 | 2.5 | A |
| Example 11 | 4 | 5 | 5 | 2.5 | A |
| Example 12 | 3 | 5 | 5 | 2.5 | A |
| Example 13 | 2 | 5 | 5 | 2.49 | A |
| Example 14 | 3 | 5 | 5 | 2.49 | A |
| Example 15 | 5 | 4 | 4 | 2.5 | A |
| Example 16 | 5 | 4 | 4 | 2.5 | A |
| Comparative Example 1 | 5 | 1 | 1 | 2.53 | B |
| Comparative Example 2 | 5 | 1 | 1 | 2.53 | B |
| Comparative Example 3 | 1 | 5 | 1 | 2.43 | B |
| Comparative Example 4 | 1 | 3 | 1 | 2.49 | B |
| Comparative Example 5 | 1 | 2 | 1 | 2.52 | B |
| Comparative Example 6 | 4 | 3 | 1 | 2.49 | B |
| Comparative Example 7 | 5 | 2 | 2 | 2.43 | C |
| Comparative Example 8 | 5 | 2 | 2 | 2.43 | C |
| Comparative Example 9 | 5 | 3 | 2 | 2.26 | B |
| Comparative Example 10 | 5 | 3 | 2 | 2.24 | B |

It is understood from Table 4 that the alumina hydrate and the above-described cationic polymer are slowly flocculated in the course of dispersion of the lower layer coating liquid. Also, rapid flocculation is caused by the vaporization of water in a drying process; the ratio of the amounts of polyvinyl alcohols as the binders contained in the upper layer and lower layer was changed to more increase the rate of gelation in the lower layer than the upper layer in the drying process, making it possible to keep the cationic polymer in the lower layer. It is also found that since the diffusion of the cationic polymer into the upper layer was limited, so that no cationic polymer was contained in the upper layer of the ink-receiving layer to prevent the bronzing of cyan ink and the migration of magenta ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-109894, filed Apr. 18, 2007, which is hereby incorporated by reference herein in its entirety.

What is claimed is:

1. An ink jet recording medium comprising a substrate and an ink receiving layer provided with at least an upper layer and a lower layer formed on said substrate, wherein said upper layer:

(A) constitutes the outermost layer of said ink receiving layer;

(B) contains none of a polyallylamine hydrochloride, a methyldiallylamine hydrochloride polymer and a diallylamine hydrochloride-sulfur dioxide copolymer; and (C) contains inorganic pigment particles, a binder and an alkylsulfonic acid of which the alkyl group is a straight or branched unsubstituted alkyl group having 1 to 4 carbon atoms; and said lower layer:

(D) is a layer lying just under said upper layer; and (E) contains at least one cationic polymer selected from the group consisting of a polyallylamine hydrochloride, a methyldiallylamine hydrochloride polymer and a diallylamine hydrochloride-sulfur dioxide copolymer, inorganic pigment particles, a binder and an alkylsulfonic acid of which the alkyl group is a straight or branched unsubstituted alkyl group having 1 to 4 carbon atoms;

wherein the ratio by mass of the cationic polymer contained in said lower layer to the inorganic pigment particles contained in said upper layer and lower layer, {(Cationic polymer)/(Inorganic pigment particles)×100}, is 0.1% or more and 1% or less; and wherein the ratio by mass of the alkylsulfonic acid to said inorganic pigment particles contained in said upper layer and lower layer, {(Alkylsulfonic acid)/(Inorganic pigment particles)×100}, is 1.4% or more and 2.1% or less.

2. An ink jet recording medium according to claim 1, wherein all the inorganic pigment particles in said upper layer and lower layer are alumina hydrates, and wherein said upper and lower layers both have porous structures formed of the alumina hydrate and the binder.

3. An ink jet recording medium according to claim 1, wherein the total thickness of said upper and lower layers is 30 μm or more.

4. An ink jet recording medium according to claim 1, wherein the thickness of said upper layer is 2 μm or more and 10 μm or less.

5. A method of producing an ink jet recording medium, the method comprising applying an upper layer coating liquid and a lower layer coating liquid to the surface of a substrate to form an ink receiving layer provided with an upper layer and a lower layer on the substrate, wherein said upper layer coating liquid:

contains inorganic pigment particles, a binder and an alkylsulfonic acid of which the alkyl group is a straight or branched unsubstituted alkyl group having 1 to 4 carbon atoms; and contains none a polyallylamine hydrochloride, a methyldiallylamine hydrochloride polymer and a diallylamine hydrochloride-sulfur dioxide copolymer; and said lower layer coating liquid:

contains at least one cationic polymer selected from the group consisting of a polyallylamine hydrochloride, a methyldiallylamine hydrochloride polymer and a diallylamine hydrochloride-sulfur dioxide copolymer, inorganic pigment particles, a binder and an alkylsulfonic acid of which the alkyl group is a straight or branched unsubstituted alkyl group having 1 to 4 carbon atoms;

wherein the ratio by mass of the cationic polymer contained in the lower layer coating liquid to the inorganic pigment particles contained in the upper layer coating liquid and lower layer coating liquid, {(Cationic polymer)/(Inorganic pigment particles)×100}, is 0.1% or more and 1% or less; and wherein the ratio by mass of the alkylsulfonic acid to the inorganic pigment particles contained in the upper layer coating liquid and lower layer coating liquid, {(Alkylsulfonic acid)/(Inorganic pigment particles)×100}, is 1.4% or more and 2.1% or less.

6. A method of producing an ink jet recording medium according to claim 5, wherein said lower layer coating liquid and said upper layer coating liquid are applied simultaneously to the substrate.

7. A method of producing an ink jet recording medium according to claim 5, wherein the inorganic pigment particles in said upper layer coating liquid and lower layer coating liquid are alumina hydrates.

* * * * *